US010121444B2

(12) United States Patent
Choi et al.

(10) Patent No.: US 10,121,444 B2
(45) Date of Patent: Nov. 6, 2018

(54) DISPLAY PANEL DRIVING APPARATUS, DISPLAY AND METHOD FOR CORRECTING POSITIVE AND NEGATIVE POLARITY GRAYSCALE VOLTAGE

(71) Applicant: Samsung Display Co., LTD., Yongin-si, Gyeonggi-Do (KR)

(72) Inventors: Hyong-Do Choi, Yongin-si (KR); Yun-Nam Kim, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 159 days.

(21) Appl. No.: 15/082,650

(22) Filed: Mar. 28, 2016

(65) Prior Publication Data

US 2017/0084218 A1 Mar. 23, 2017

(30) Foreign Application Priority Data

Sep. 23, 2015 (KR) ..... 10-2015-0134664

(51) Int. Cl.
*G09G 3/36* (2006.01)

(52) U.S. Cl.
CPC ..... *G09G 3/3688* (2013.01); *G09G 3/3611* (2013.01); *G09G 3/3614* (2013.01); *G09G 3/3696* (2013.01); *G09G 2310/0243* (2013.01); *G09G 2310/0291* (2013.01); *G09G 2320/0247* (2013.01); *G09G 2320/04* (2013.01)

(58) Field of Classification Search
CPC .. G09G 3/3611; G09G 3/3696; G09G 3/3688; G09G 3/3685; G09G 3/3275; G09G 2310/0291; G09G 2310/0243; G09G 2320/0673; G09G 2330/028; G09G 3/3614; G09G 2320/0247; G09G 2320/04
See application file for complete search history.

(56) References Cited

U.S. PATENT DOCUMENTS 8,022,910 B2 * 9/2011 Kim ..... G09G 3/2011 345/204
8,976,097 B2 * 3/2015 Lee ..... G09G 3/3696 345/89

(Continued)

FOREIGN PATENT DOCUMENTS

KR 1020090105176 A 10/2009
KR 1020090109610 A 10/2009
KR 1020140144310 A 12/2014

*Primary Examiner* — Darlene M Ritchie
(74) *Attorney, Agent, or Firm* — Cantor Colburn LLP

(57) ABSTRACT

A display panel driving apparatus includes a grayscale voltage outputting part which generates a first positive polarity grayscale voltage and a first polarity negative grayscale voltage, compares the first positive polarity with a first reference voltage to output a first comparison voltage, compares the first negative polarity grayscale voltage with a second reference voltage to output a second comparison voltage, compares the first comparison voltage with the second comparison voltage to output a voltage deviation value, and outputs a second positive polarity grayscale voltage and a second negative polarity grayscale voltage based on the voltage deviation value, and a data driving part which outputs a data signal based on image data to a data line of a display panel, using the second positive polarity grayscale voltage and the second negative polarity grayscale voltage.

18 Claims, 19 Drawing Sheets

(56) References Cited

U.S. PATENT DOCUMENTS

| | | | | |
|---|---|---|---|---|
| 9,721,515 | B2 * | 8/2017 | Syu | G02F 1/133 |
| 2005/0110738 | A1 * | 5/2005 | Kim | G09G 3/3648 345/100 |
| 2009/0046083 | A1 * | 2/2009 | Kim | G09G 3/20 345/204 |
| 2010/0001984 | A1 * | 1/2010 | Kim | G09G 3/3696 345/212 |
| 2010/0045708 | A1 * | 2/2010 | Higashino | G09G 3/3685 345/690 |
| 2010/0207929 | A1 * | 8/2010 | Miyazaki | G09G 3/3696 345/213 |
| 2010/0328289 | A1 * | 12/2010 | Enrin | G09G 3/3688 345/211 |
| 2011/0141098 | A1 * | 6/2011 | Yaguma | G09G 3/3688 345/212 |
| 2011/0227891 | A1 * | 9/2011 | Lee | G09G 3/3655 345/211 |
| 2011/0234560 | A1 * | 9/2011 | Shin | G09G 3/003 345/208 |
| 2012/0162272 | A1 * | 6/2012 | Lee | G09G 5/10 345/690 |
| 2013/0002641 | A1 * | 1/2013 | Kim | G09G 3/3685 345/212 |
| 2013/0249881 | A1 * | 9/2013 | Chae | G09G 3/32 345/211 |
| 2015/0054810 | A1 * | 2/2015 | Lin | G09G 3/3655 345/211 |
| 2015/0228234 | A1 * | 8/2015 | Lin | G09G 3/3614 345/212 |
| 2016/0307536 | A1 * | 10/2016 | Okabe | G02F 1/1368 |

* cited by examiner

DISPLAY PANEL DRIVING APPARATUS, DISPLAY AND METHOD FOR CORRECTING POSITIVE AND NEGATIVE POLARITY GRAYSCALE VOLTAGE

This application claims priority to Korean Patent Application No. 10-2015-0134664, filed on Sep. 23, 2015, and all the benefits accruing therefrom under 35 U.S.C. § 119, the content of which in its entirety is herein incorporated by reference.

BACKGROUND

1. Field

Exemplary embodiments of the invention relate to a display panel driving apparatus, a method of driving a display panel using the display panel driving apparatus, and a display apparatus having the display panel driving apparatus. More particularly, exemplary embodiments of the invention relate to a display panel driving apparatus outputting a data signal to a data line using a grayscale voltage, a method of driving a display panel using the display panel driving apparatus, and a display apparatus including the display panel driving apparatus.

2. Description of the Related Art

A display apparatus generally includes a display panel and a display panel driving apparatus.

The display panel may include a lower substrate, an upper substrate and a liquid crystal layer interposed therebetween. The lower substrate may include a first base substrate, a gate line, a data line, a thin film transistor and a pixel electrode. The upper substrate may include a second base substrate and a common electrode. The liquid crystal layer includes a liquid crystal. A pixel voltage is applied to the pixel electrode, and a common voltage is applied to the common electrode. An arrangement of the liquid crystal is changed by an electric field generated by the pixel voltage and the common voltage.

The display panel driving apparatus may include a gate driving part, a data driving part and a timing controlling part.

The gate driving part generates a gate signal and outputs the gate signal to the gate line of the display panel.

The data driving part receives image data from the timing controlling part, and outputs a data signal based on the image data to the data line of the display panel. Here, the data driving part may generate the data signal using a grayscale voltage.

SUMMARY

Exemplary embodiments of the invention provide a display panel driving apparatus which optimizes a grayscale voltage and improves display quality of a display apparatus.

Exemplary embodiments of the invention also provide a method of driving a display panel using the above-mentioned display panel driving apparatus.

Exemplary embodiments of the invention also provide a display apparatus having the above-mentioned display panel driving apparatus.

According to an exemplary embodiment of the invention, a display panel driving apparatus includes a grayscale voltage outputting part, a data driving part and a gate driving part. The grayscale voltage outputting part generates a first positive polarity grayscale voltage and a first polarity negative grayscale voltage, compares the first positive polarity with a first reference voltage to output a first comparison voltage, compares the first negative polarity grayscale voltage with a second reference voltage to output a second comparison voltage, compares the first comparison voltage with the second comparison voltage to output a voltage deviation value, and outputs a second positive polarity grayscale voltage and a second negative polarity grayscale voltage based on the voltage deviation value. The data driving part outputs a data signal based on image data to a data line of a display panel, based on the second positive polarity grayscale voltage and the second negative polarity grayscale voltage. The gate driving part outputs a gate signal to a gate line of the display panel.

In an exemplary embodiment, the grayscale voltage outputting part may include a grayscale voltage generating part which outputs the first positive polarity grayscale voltage and the first negative polarity grayscale voltage, and a grayscale voltage adjusting part which outputs the second positive polarity grayscale voltage and the second negative polarity grayscale voltage of which absolute values are the same, based on the first positive polarity grayscale voltage, the first negative polarity grayscale voltage, the first reference voltage, the second reference voltage, a positive polarity driving voltage and a negative polarity driving voltage.

In an exemplary embodiment, each of the first reference voltage and the second reference voltage may be a ground voltage.

In an exemplary embodiment, the grayscale voltage adjusting part may include a first comparing part which compares the first positive polarity grayscale voltage with the ground voltage to output a positive polarity grayscale voltage absolute value, a second comparing part which compares the first negative polarity grayscale voltage with the ground voltage to output a negative polarity grayscale voltage absolute value, a third comparing part which compares the positive polarity grayscale voltage absolute value with the negative polarity grayscale voltage absolute value to output a voltage deviation value, and a resistor part which controls a resistance based on the voltage deviation value and output the second positive polarity grayscale voltage and the second negative polarity grayscale voltage.

In an exemplary embodiment, the first comparing part may include an operational amplifier ("OP-AMP") including a first terminal which receives the first positive polarity grayscale voltage, a second terminal which receives the ground voltage, a third terminal which receives the positive polarity driving voltage, a fourth terminal which receives the negative polarity driving voltage, and a fifth terminal which outputs the positive polarity grayscale voltage absolute value.

In an exemplary embodiment, the second comparing part may include an OP-AMP including a first terminal which receives the ground voltage, a second terminal which receives the first negative polarity grayscale voltage, a third terminal which receives the positive polarity driving voltage, a fourth terminal which receives the negative polarity driving voltage, and a fifth terminal which outputs the negative polarity grayscale voltage absolute value.

In an exemplary embodiment, the third comparing part may include an OP-AMP including a first terminal which receives the positive polarity grayscale voltage absolute value, a second terminal which receives the negative polarity grayscale voltage absolute value, a third terminal which receives the positive polarity driving voltage, a fourth terminal which receives the negative polarity driving voltage, and a fifth terminal which outputs the voltage deviation value.

In an exemplary embodiment, the resistor part may include a variable resistor of which a resistance is controlled according to the voltage deviation value.

In an exemplary embodiment, the grayscale voltage outputting part may include a grayscale voltage generating part which outputs the first positive polarity grayscale voltage and the first negative polarity grayscale voltage, and a grayscale voltage adjusting part which outputs the second positive polarity grayscale voltage and the second negative polarity grayscale voltage of which absolute values are different, based on the first positive polarity grayscale voltage, the first negative polarity grayscale voltage, a positive polarity driving voltage and a negative polarity driving voltage.

In an exemplary embodiment, the first reference voltage may be a first offset voltage, the second reference voltage may be a second offset voltage, and the grayscale voltage adjusting part may include a first comparing part which compares the first positive polarity grayscale voltage with the first offset voltage to output the first comparison voltage, a second comparing part which compares the first negative polarity grayscale voltage with the second offset voltage to output the second comparison voltage, a third comparing part which compares the first comparison voltage with the second comparison voltage to output a voltage deviation value, and a resistor part which controls a resistance based on the voltage deviation value and output the second positive polarity grayscale voltage and the second negative polarity grayscale voltage.

In an exemplary embodiment, the first comparing part may include an OP-AMP including a first terminal which receives the first positive polarity grayscale voltage, a second terminal which receives the first offset voltage, a third terminal which receives the positive polarity driving voltage, a fourth terminal which receives the negative polarity driving voltage, and a fifth terminal which outputs the first comparison voltage.

In an exemplary embodiment, the second comparing part may include an OP-AMP including a first terminal which receives the second offset voltage, a second terminal which receives the first negative polarity grayscale voltage, a third terminal which receives the positive polarity driving voltage, a fourth terminal which receives the negative polarity driving voltage, and a fifth terminal which outputs the second comparison voltage.

In an exemplary embodiment, the third comparing part may include an OP-AMP including a first terminal which receives the first comparison voltage, a second terminal which receives the second comparison voltage, a third terminal which receives the positive polarity driving voltage, a fourth terminal which receives the negative polarity driving voltage, and a fifth terminal which outputs the voltage deviation value.

In an exemplary embodiment, the resistor part may include a variable resistor of which a resistance is controlled according to the voltage deviation value.

In an exemplary embodiment, the grayscale voltage adjusting part may further include a first offset voltage part which outputs the first offset voltage, and a second offset voltage part which outputs the second offset voltage.

In an exemplary embodiment, the first offset voltage part may include a first resistor connected between the first comparing part and a terminal to which a ground voltage is applied, a first positive polarity resistor connected between the first resistor and a terminal to which the positive polarity driving voltage is applied, and a first negative polarity resistor connected between the first resistor and a terminal to which the negative polarity driving voltage is applied.

In an exemplary embodiment, the second offset voltage part may include a second resistor connected between the second comparing part and a terminal to which a ground voltage is applied, a second positive polarity resistor connected between the second resistor and a terminal to which the positive polarity driving voltage is applied, and a second negative polarity resistor connected between the second resistor and a terminal to which the negative polarity driving voltage is applied.

In an exemplary embodiment, the display panel driving apparatus may further include a timing controlling part which controls a timing of the data driving part and a timing of the gate driving part, receive a feedback signal based on the second positive polarity grayscale voltage and the second negative polarity grayscale voltage, and output a grayscale voltage control signal for controlling the first positive polarity grayscale voltage and the first negative polarity grayscale voltage to the grayscale voltage outputting part, and the grayscale voltage outputting part may receive a vertical start signal from the timing controlling part and may output the second positive polarity grayscale voltage and the second negative grayscale voltage in a frame period.

According to an exemplary embodiment of the invention, a method of driving a display panel includes generating a first positive polarity grayscale voltage and a first negative polarity grayscale voltage, comparing the first positive polarity grayscale voltage with a first reference voltage to output a first comparison voltage, comparing the first negative polarity grayscale voltage with a second reference voltage to output a second comparison voltage, comparing the first comparison voltage with the second comparison voltage to output a voltage deviation value, outputting a second positive polarity grayscale voltage and a second negative polarity grayscale voltage based on the voltage deviation value, outputting a data signal based on image data to a data line of the display panel, using the second positive polarity grayscale voltage and the second negative polarity grayscale voltage, and outputting a gate signal to a gate line of the display panel.

According to an exemplary embodiment of the invention, a display apparatus includes a display panel and a display panel driving apparatus. The display panel displays an image and includes a gate line and a data line. The display panel driving apparatus includes a grayscale voltage outputting part which generates a first positive polarity grayscale voltage and a first polarity negative grayscale voltage, compares the first positive polarity with a first reference voltage to output a first comparison voltage, compares the first negative polarity grayscale voltage with a second reference voltage to output a second comparison voltage, compares the first comparison voltage with the second comparison voltage to output a voltage deviation value, and outputs a second positive polarity grayscale voltage and a second negative polarity grayscale voltage based on the voltage deviation value, a data driving part which outputs a data signal based on image data to the data line of the display panel, using the second positive polarity grayscale voltage and the second negative polarity grayscale voltage, and a gate driving part which outputs a gate signal to the gate line of the display panel.

According to the invention, a grayscale voltage adjusting part controls a resistance of a variable resistor according to a voltage deviation value based on a first positive polarity grayscale voltage and a first negative polarity grayscale voltage to output a second positive polarity grayscale voltage and a second negative polarity grayscale voltage, and thus the second positive polarity grayscale voltage and the second negative polarity grayscale voltage may be optimized. Thus, display quality of a display apparatus may be improved.

BRIEF DESCRIPTION OF THE DRAWINGS

The above and other features and advantages of the invention will become more apparent by describing in detailed example embodiments thereof with reference to the accompanying drawings, in which.

DETAILED DESCRIPTION

Figure 1:
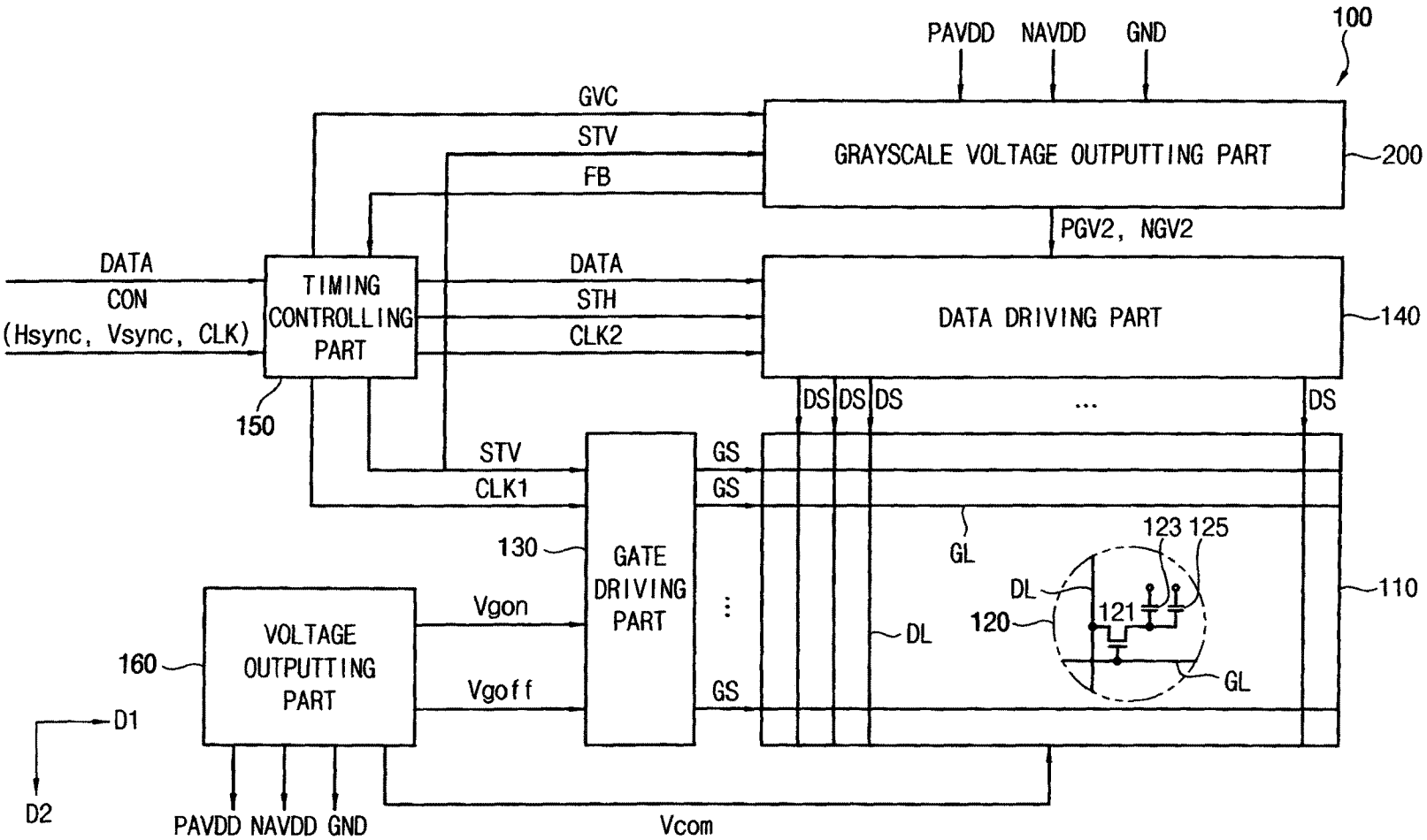
FIG. 1 is a block diagram illustrating an exemplary embodiment of a display apparatus according to the invention.

Hereinafter, the invention will be explained in detail with reference to the accompanying drawings. This invention may, however, be embodied in many different forms, and should not be construed as limited to the embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Figure 2:
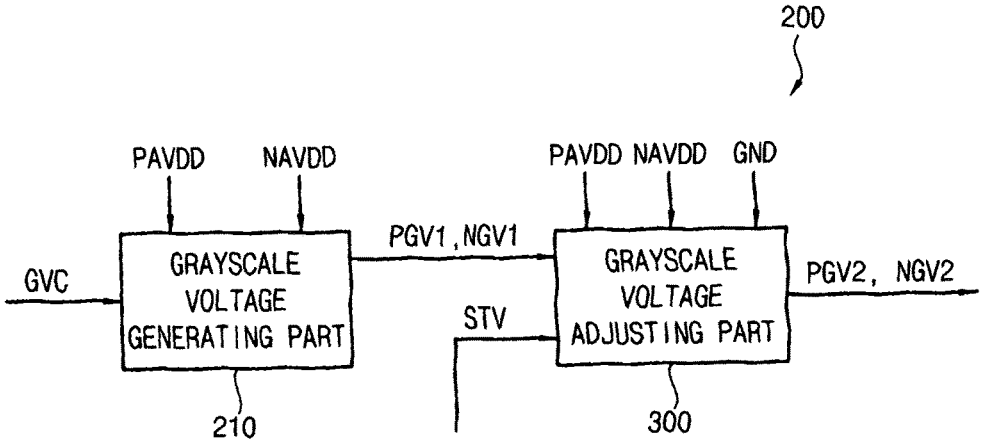
FIG. 2 is a block diagram illustrating a grayscale voltage outputting part of FIG. 1.

FIG. 1 is a block diagram illustrating a display apparatus according to an exemplary embodiment of the invention. FIG. 2 is a block diagram illustrating a grayscale voltage outputting part of FIG. 1.

Referring to FIGS. 1 and 2, the display apparatus 100 according to the illustrated exemplary embodiment includes a display panel 110, a gate driving part 130, a data driving part 140, a timing controlling part 150, a voltage outputting part 160 and a grayscale voltage outputting part 200. The gate driving part 130, the data driving part 140, the timing controlling part 150, the voltage outputting part 160 and the grayscale voltage outputting part 200 may be defined as a display panel driving apparatus driving the display panel 110.

The display panel 110 receives a data signal DS based on image data DATA to display an image. The display panel 110 includes gate lines GL, data lines DL and a plurality of pixels 120. The gate lines GL extend in a first direction D1 and are arranged in a second direction D2 substantially perpendicular to the first direction D1. The data lines DL extend in the second direction D2 and are arranged in the first direction D1. Each of the pixels 120 includes a thin film transistor ("TFT") 121 electrically connected to the gate line GL and the data line DL, a liquid crystal capacitor 123 and a storage capacitor 125 connected to the TFT 121. Thus, the display panel 110 may be a liquid crystal display panel. Alternatively, the display panel 110 may be an organic light emitting diode ("OLED") display panel including an OLED.

The gate driving part 130 generates a gate signal GS in response to a vertical start signal STV and a first clock signal CLK1 provided from the timing controlling part 150, and outputs the gate signal GS to the gate line GL.

The data driving part 140 outputs the data signals DS to the data line DL in response to a horizontal start signal STH and a second clock signal CLK2 provided from the timing controlling part 150.

The timing controlling part 150 receives the image data DATA and a control signal CON from an outside. The timing controlling part 150 may output the image data DATA to the data driving part 140. The control signal CON may include a horizontal synchronous signal Hsync, a vertical synchronous signal Vsync and a clock signal CLK. The timing controlling part 150 generates the horizontal start signal STH using the horizontal synchronous signal Hsync and outputs the horizontal start signal STH to the data driving part 140. In addition, the timing controlling part 150 generates the vertical start signal STV using the vertical synchronous signal Vsync and outputs the vertical start signal STV to the gate driving part 130. In addition, the timing controlling part 150 generates the first clock signal CLK1 and the second clock signal CLK2 using the clock signal CLK, outputs the first clock signal CLK1 to the gate driving part 130, and outputs the second clock signal CLK2 to the data driving part 140.

The voltage outputting part 160 outputs a common voltage Vcom to the display panel 110. In addition, the voltage outputting part 160 outputs a gate on voltage Vgon and a gate off voltage Vgoff to the gate driving part 130. In this case, the gate driving part 130 may generate the gate signal GS using the gate on voltage Vgon and the gate off voltage Vgoff. In addition, the voltage outputting part 160 outputs a positive polarity driving voltage PAVDD, a negative polarity driving voltage NAVDD and a ground voltage GND to the grayscale voltage outputting part 200. Here, the ground voltage GND may be defined as a reference voltage.

The grayscale voltage outputting part 200 may include a grayscale voltage generating part 210 and a grayscale voltage adjusting part 300.

The grayscale voltage generating part 210 generates a first positive polarity grayscale voltage PGV1 and a first negative polarity grayscale voltage NGV1 using the positive polarity driving voltage PAVDD and the negative polarity driving voltage NAVDD. Each of the first positive polarity grayscale voltage PGV1 and the first negative polarity grayscale voltage NGV1 may be a black grayscale voltage. In an exemplary embodiment, when the display panel 110 is a plane to line switching ("PLS") panel, each of the first positive polarity grayscale voltage PGV1 and the first negative polarity grayscale voltage NGV1 may be the black grayscale voltage, for example. In an alternative exemplary embodiment, each of the first positive polarity grayscale voltage PGV1 and the first negative polarity grayscale voltage NGV1 may be a white grayscale voltage. In an exemplary embodiment, when the display panel 110 is twisted nematic ("TN") panel, each of the first positive polarity grayscale voltage PGV1 and the first negative polarity grayscale voltage NGV1 may be the white grayscale voltage, for example.

The grayscale voltage adjusting part 300 receives the first positive polarity grayscale voltage PGV1 and the first negative polarity grayscale voltage NGV1, and outputs a second positive polarity grayscale voltage PGV2 and a second negative polarity grayscale voltage NGV2 of which absolute values are substantially the same. The grayscale voltage adjusting part 300 may output the second positive polarity grayscale voltage PGV2 and the second negative polarity grayscale voltage NGV2 of which the absolute values are substantially the same based on the first positive polarity grayscale voltage PGV1, the first negative polarity grayscale voltage NGV1, the ground voltage GND, the positive polarity driving voltage PAVDD and the negative polarity driving voltage NAVDD. In this case, the data driving part 140 may generate the data signal DS using the second positive polarity grayscale voltage PGV2 and the second negative polarity grayscale voltage NGV2.

The second positive polarity grayscale voltage PGV2 may be an adjusted voltage of the first positive polarity grayscale voltage PGV1 and the second negative polarity grayscale voltage NGV2 may be an adjusted voltage of the first negative polarity grayscale voltage NGV1. The grayscale voltage adjusting part 300 may output a feedback signal FB based on the second positive polarity grayscale voltage PGV2 and the second negative polarity grayscale voltage NGV2 to the timing controlling part 150. In this case, the timing controlling part 150 receiving the feedback signal FB may output a grayscale voltage control signal GVC for controlling the first positive polarity grayscale voltage PGV1 and the first negative polarity grayscale voltage NGV1 to the grayscale voltage outputting part 200. The grayscale voltage generating part 210 may generate the first positive polarity grayscale voltage PGV1 and the first negative polarity grayscale voltage NGV1 based on the grayscale voltage control signal GVC.

The grayscale voltage adjusting part 300 may output the second positive polarity grayscale voltage PGV2 and the second negative polarity grayscale voltage NGV2 in a frame period. In an exemplary embodiment, the grayscale voltage adjusting part 300 may receive the vertical start signal STV output from the timing controlling part 150, and may output the second positive polarity grayscale voltage PGV2 and the second negative polarity grayscale voltage NGV2 in an activation of the vertical start signal STV, for example.

Figure 3:
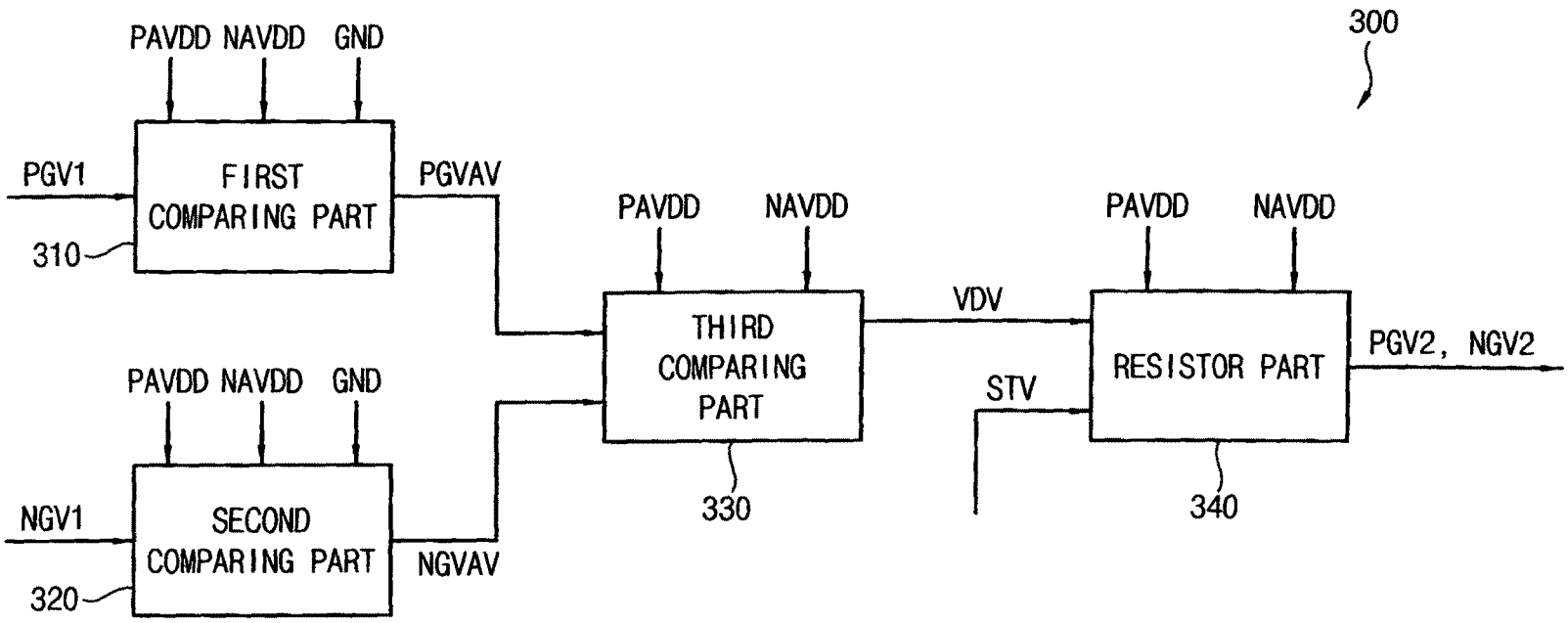
FIG. 3 is a block diagram illustrating a grayscale voltage adjusting part of FIG. 2.
Figure 4:
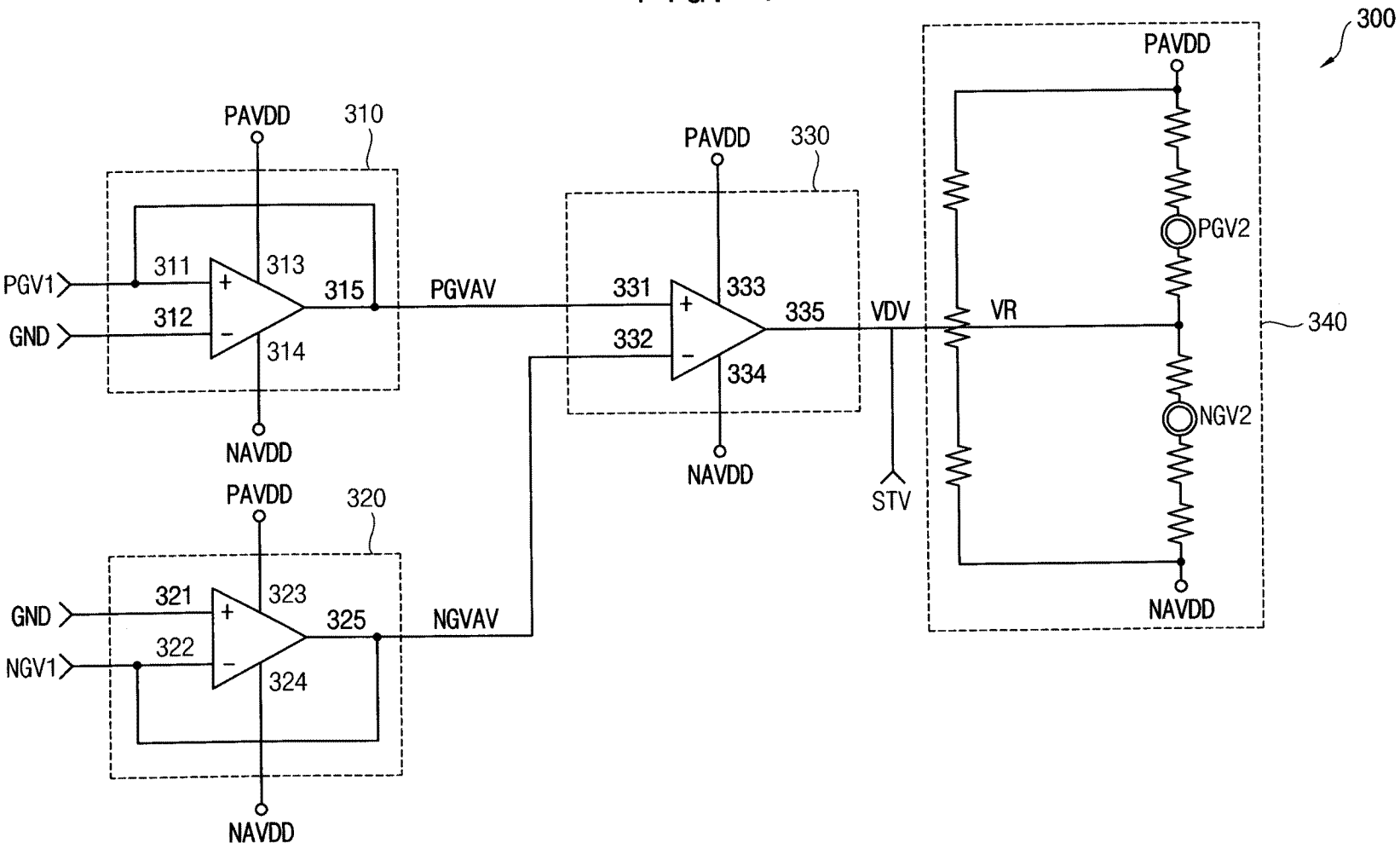
FIG. 4 is a circuit diagram illustrating the grayscale voltage adjusting part of FIG. 2.

FIG. 3 is a block diagram illustrating the grayscale voltage adjusting part 300 of FIG. 2. FIG. 4 is a circuit diagram illustrating the grayscale voltage adjusting part 300 of FIG. 2.

Referring to FIGS. 1 to 4, the grayscale voltage adjusting part 300 includes a first comparing part 310, a second comparing part 320, a third comparing part 330 and a resistor part 340.

The first comparing part 310 compares the first positive polarity grayscale voltage PGV1 with the ground voltage GND to output a positive polarity grayscale voltage absolute value PGVAV. The ground voltage GND applied to the first comparing part 310 may be defined as a first reference voltage. In addition, the positive polarity grayscale voltage absolute value PGVAV is output from the first comparing part 310, and thus the positive polarity grayscale voltage absolute value PGVAV may be defined as a first comparison voltage.

The first comparing part 310 may include an operational amplifier. The operational amplifier ("OP-AMP") of the first comparing part 310 may include a first terminal 311, a second terminal 312, a third terminal 313, a fourth terminal 314 and a fifth terminal 315. The first terminal 311 is a non-inverting terminal and receives the first positive polarity grayscale voltage PGV1. The second terminal 312 is an inverting terminal and receives the ground voltage GND. The third terminal 313 receives the positive polarity driving voltage PAVDD. The fourth terminal 314 receives the negative polarity driving voltage NAVDD. The fifth terminal 315 is an output terminal and outputs the positive polarity grayscale voltage absolute value PGVAV.

The second comparing part 320 compares the first negative polarity grayscale voltage NGV1 with the ground voltage GND to output a negative polarity grayscale voltage absolute value NGVAV. The ground voltage GND applied to the second comparing part 320 may be defined as a second reference voltage. In addition, the negative polarity grayscale voltage absolute value NGVAV is output from the second comparing part 320, and thus the negative polarity grayscale voltage absolute value NGVAV may be defined as a second comparison voltage.

The second comparing part 320 may include an operational amplifier. The OP-AMP of the second comparing part 320 may include a first terminal 321, a second terminal 322, a third terminal 323, a fourth terminal 324 and a fifth terminal 325. The first terminal 321 is a non-inverting terminal and receives the ground voltage GND. The second terminal 322 is an inverting terminal and receives the first negative polarity grayscale voltage NGV1. The third terminal 323 receives the positive polarity driving voltage PAVDD. The fourth terminal 324 receives the negative polarity driving voltage NAVDD. The fifth terminal 325 is an output terminal and outputs the negative polarity grayscale voltage absolute value NGVAV.

The third comparing part 330 compares the positive polarity grayscale voltage absolute value PGVAV with the negative polarity grayscale voltage absolute value NGVAV to output a voltage deviation value VDV.

The third comparing part 330 may include an operational amplifier. The OP-AMP of the third comparing part 330 may include a first terminal 331, a second terminal 332, a third terminal 333, a fourth terminal 334 and a fifth terminal 335. The first terminal 331 is a non-inverting terminal and receives the positive polarity grayscale voltage absolute value PGVAV. The second terminal 332 is an inverting terminal and receives the negative polarity grayscale voltage absolute value NGVAV. The third terminal 333 receives the positive polarity driving voltage PAVDD. The fourth terminal 334 receives the negative polarity driving voltage NAVDD. The fifth terminal 335 is an output terminal and outputs the voltage deviation value VDV.

The resistor part 340 controls a resistance thereof based on the voltage deviation value VDV and outputs the second positive polarity grayscale voltage PGV2 and the second negative polarity grayscale voltage NGV2. The positive polarity driving voltage PAVDD and the negative polarity driving voltage NAVDD are applied to the resistor part 340. The resistor part 340 includes a variable resistor VR of which the resistance is controlled based on the voltage deviation value VDV. In an exemplary embodiment, the variable resistor VR may be a digital variable resistor, for example. The resistor part 340 may output the second positive polarity grayscale voltage PGV2 and the second negative polarity grayscale voltage NGV2 by controlling the resistance of the variable resistor VR based on the voltage deviation value VDV, in response to the activation of the vertical start signal STV received from the timing controlling part 150. When the positive polarity grayscale voltage absolute value PGVAV and the negative polarity grayscale voltage absolute value NGVAV are substantially the same and thus the voltage deviation value is about zero, the resistor part 340 may not change the resistance of the variable resistor VR. In this case, the second positive polarity grayscale voltage PGV2 may be substantially the same as the first positive polarity grayscale voltage PGV1, and the second negative polarity grayscale voltage NGV2 may be substantially the same as the first negative polarity grayscale voltage NGV1.

The grayscale voltage adjusting part 300 may further include a feedback signal part (not shown) which generates the feedback signal FB based on the second positive polarity grayscale voltage PGV2 and the second negative polarity grayscale voltage NGV2 and outputs the feedback signal FB to the timing controlling part 150.

Figure 5A:
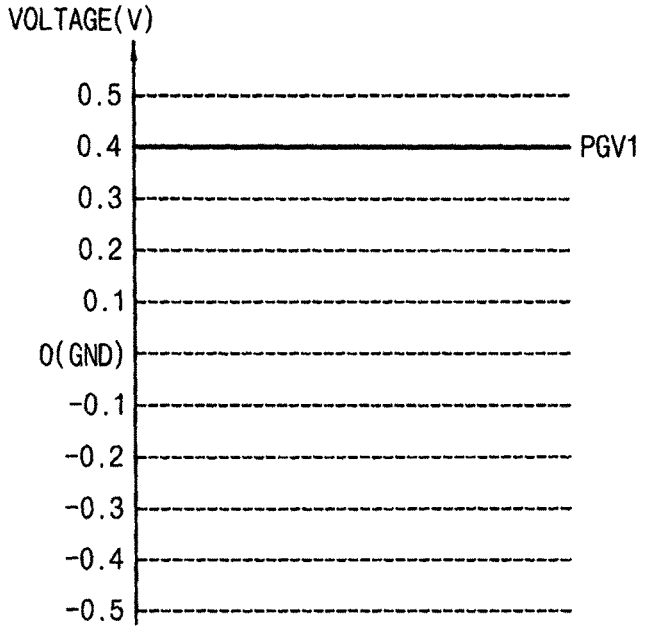
FIG. 5A is a graph illustrating a first positive polarity grayscale voltage of FIGS. 3 and 4.
Figure 5B:
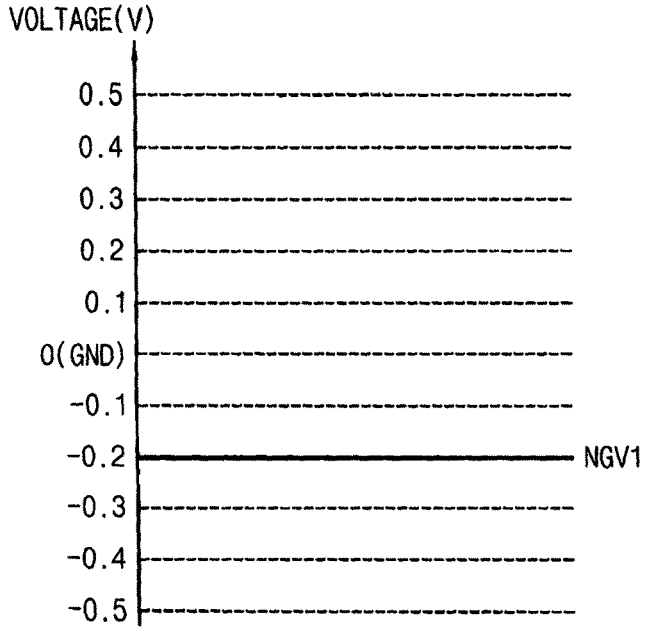
FIG. 5B is a graph illustrating a first negative polarity grayscale voltage of FIGS. 3 and 4.
Figure 5C:
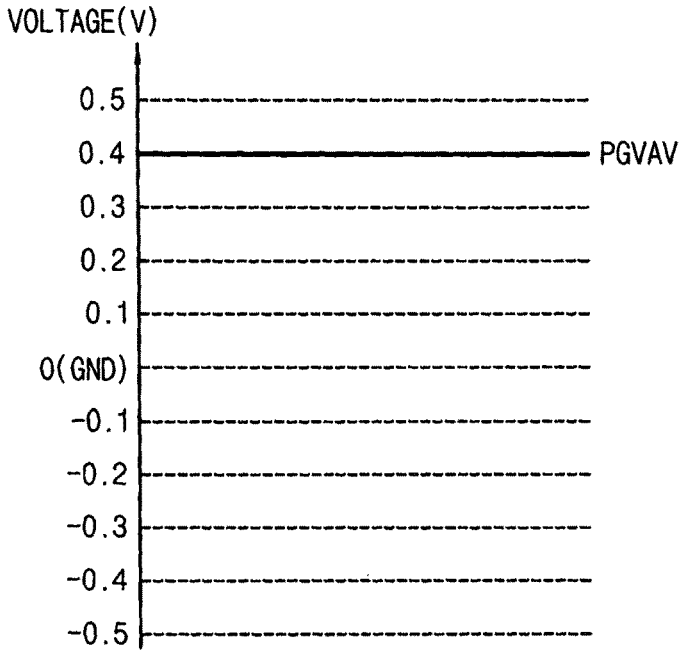
FIG. 5C is a graph illustrating a positive polarity grayscale voltage absolute value of FIGS. 3 and 4.
Figure 5D:
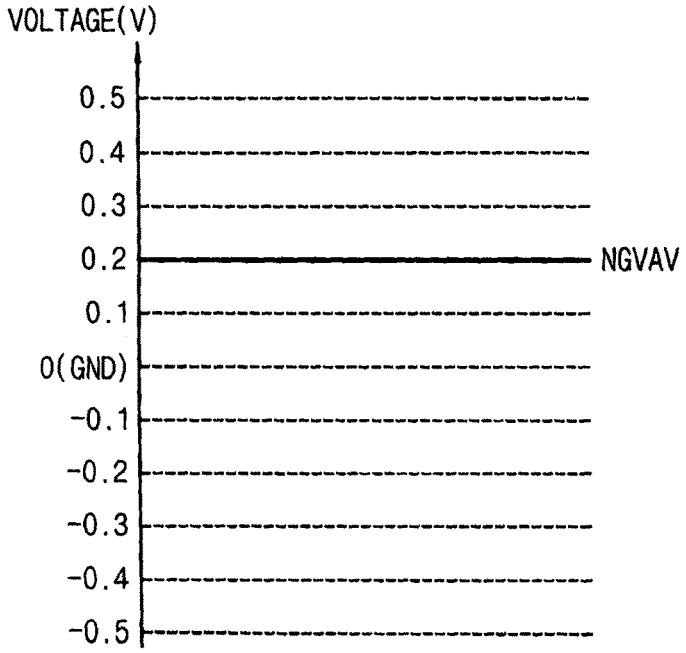
FIG. 5D is a graph illustrating a negative polarity grayscale voltage absolute value of FIGS. 3 and 4.
Figure 5E:
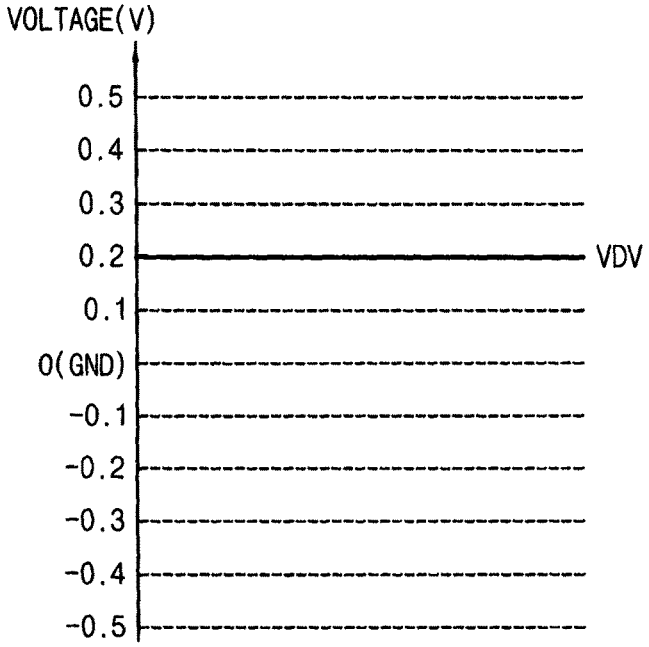
FIG. 5E is a graph illustrating a voltage deviation value of FIGS. 3 and 4.
Figure 5F:
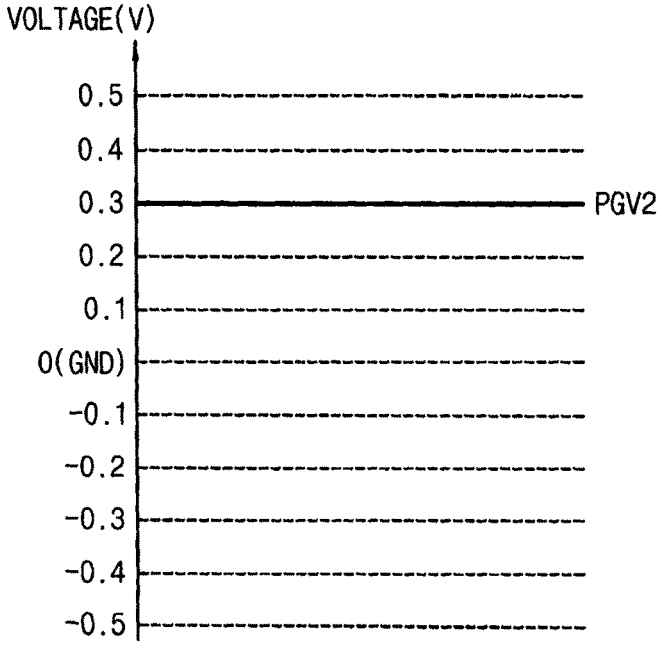
FIG. 5F is a graph illustrating a second positive polarity grayscale voltage of FIGS. 3 and 4.
Figure 5G:
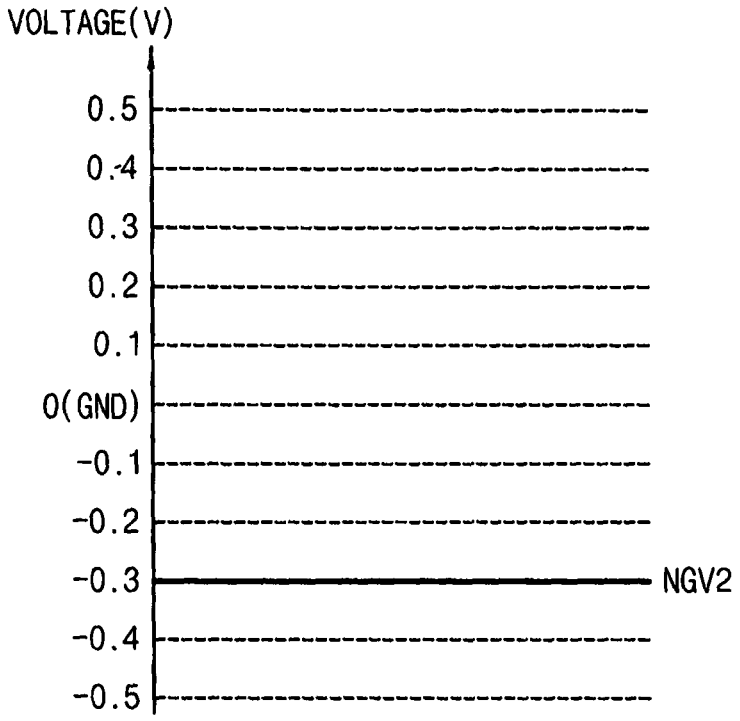
FIG. 5G is a graph illustrating a second negative polarity grayscale voltage of FIGS. 3 and 4.

FIG. 5A is a graph illustrating the first positive polarity grayscale voltage PGV1 of FIGS. 3 and 4. FIG. 5B is a graph illustrating the first negative polarity grayscale voltage NGV1 of FIGS. 3 and 4. FIG. 5C is a graph illustrating the positive polarity grayscale voltage absolute value PGVAV of FIGS. 3 and 4. FIG. 5D is a graph illustrating the negative polarity grayscale voltage absolute value NGVAV of FIGS. 3 and 4. FIG. 5E is a graph illustrating the voltage deviation value VDV of FIGS. 3 and 4. FIG. 5F is a graph illustrating the second positive polarity grayscale voltage PGV2 of FIGS. 3 and 4. FIG. 5G is a graph illustrating the second negative polarity grayscale voltage NGV2 of FIGS. 3 and 4.

Referring to FIGS. 1 to 5, for example, the first positive polarity grayscale voltage PGV1 may be about 0.4 volt (V), and the first negative polarity grayscale voltage NGV1 may be about −0.2 V. Therefore, the positive polarity grayscale voltage absolute value PGVAV output from the first comparing part 310 may be about 0.4 V, and the negative polarity grayscale voltage absolute value NGVAV output from the second comparing part 320 may be about 0.2 V. Thus, the voltage deviation value VDV output from the third comparing part 330 may be about 0.2 V. The second positive polarity grayscale voltage PGV2 output from the resistor part 340 may be about 0.3 V, and the second negative polarity grayscale voltage NGV2 output from the resistor part 340 may be about −0.3 V. The resistor part 340 may output the second positive polarity grayscale voltage PGV2 having about 0.3 V and the second negative polarity grayscale voltage NGV2 having about −0.3 V by controlling the resistance of the variable resistor VR based on the voltage deviation value VDV having about 0.2 V.

Figure 6:
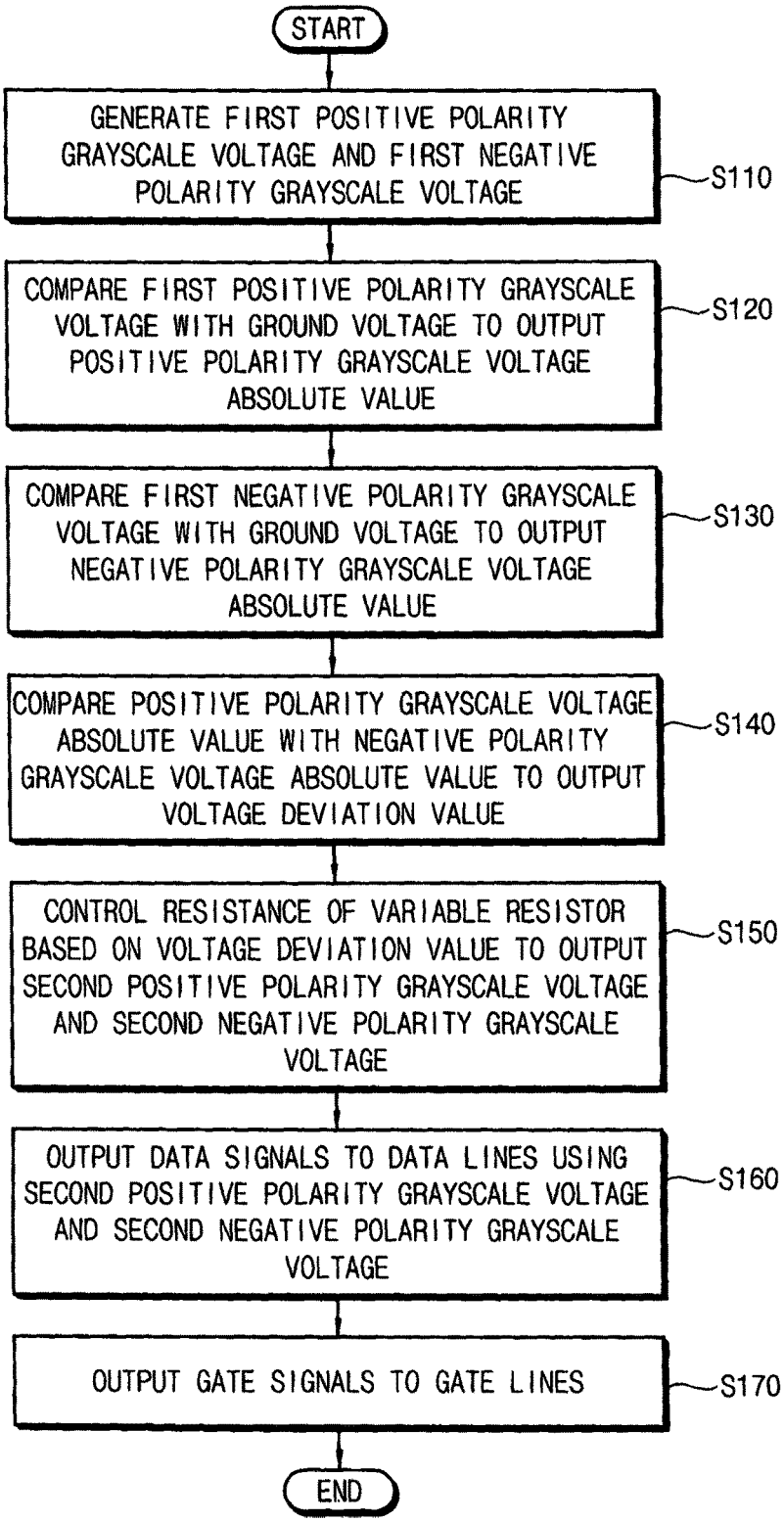
FIG. 6 is a flow chart illustrating a method of driving a display panel using a display panel driving apparatus of FIG. 1.

FIG. 6 is a flow chart illustrating a method of driving a display panel using the display panel driving apparatus of FIG. 1.

Referring to FIGS. 1 to 6, the first positive polarity grayscale voltage PGV1 and the first negative polarity grayscale voltage NGV1 are generated (operation S110). Specifically, the grayscale voltage generating part 210 generates the first positive polarity grayscale voltage PGV1 and the first negative polarity grayscale voltage NGV1 using the positive polarity driving voltage PAVDD and the negative polarity driving voltage NAVDD.

The positive polarity grayscale voltage PGV1 is compared with the ground voltage GND and the first positive polarity grayscale voltage absolute value PGVAV is output (operation S120). Specifically, the first comparing part 310 compares the first positive polarity grayscale voltage PGV1 with the ground voltage GND to output the positive polarity grayscale voltage absolute value PGVAV. The ground voltage GND applied to the first comparing part 310 may be defined as the first reference voltage. In addition, the positive polarity grayscale voltage absolute value PGVAV is output from the first comparing part 310, and thus the positive polarity grayscale voltage absolute value PGVAV may be defined as the first comparison voltage.

The first negative polarity grayscale voltage PGV1 is compared with the ground voltage GND and the negative polarity grayscale voltage absolute value NGVAV is output (operation S120). Specifically, the second comparing part 320 compares the first negative polarity grayscale voltage NGV1 with the ground voltage GND to output the negative polarity grayscale voltage absolute value NGVAV. The ground voltage GND applied to the second comparing part 320 may be defined as the second reference voltage. In addition, the negative polarity grayscale voltage absolute value NGVAV is output from the second comparing part 320, and thus the negative polarity grayscale voltage absolute value NGVAV may be defined as the second comparison voltage.

The positive polarity grayscale voltage absolute value PGVAV is compared with the negative polarity grayscale voltage absolute value NGVAV and the voltage deviation value VDV is output (operation S140). Specifically, the third comparing part 330 compares the positive polarity grayscale voltage absolute value PGVAV with the negative polarity grayscale voltage absolute value NGVAV to output the voltage deviation value VDV.

The resistance is controlled based on the voltage deviation value VDV and the second positive polarity grayscale voltage PGV2 and the second negative polarity grayscale voltage NGV2 are output (operation S150). Specifically, the resistor part 340 controls the resistance of the variable resistor VR based on the voltage deviation value VDV and outputs the second positive polarity grayscale voltage PGV2 and the second negative polarity grayscale voltage NGV2. The resistor part 340 may output the second positive polarity grayscale voltage PGV2 and the second negative polarity grayscale voltage NGV2 by controlling the resistance of the variable resistor VR based on the voltage deviation value VDV, in response to the activation of the vertical start signal STV received from the timing controlling part 150.

The data signals DS are output to the data lines DL using the second positive polarity grayscale voltage PGV2 and the second negative polarity grayscale voltage NGV2 (operation S160). Specifically, the data driving part 140 generates the data signals DS based on the image data DATA using the second positive polarity grayscale voltage PGV2 and the second negative polarity grayscale voltage NGV2, and outputs the data signals DS to the data lines DL.

The gate signals GS are output to the gate lines GL (operation S170). Specifically, the gate driving part 130 generates the gate signals GS and outputs the gate signals GL to the gate lines GL.

According to the illustrated exemplary embodiment, the grayscale voltage adjusting part 300 controls the resistance of the variable resistor VR according to the voltage deviation value VDV based on the first positive polarity grayscale voltage PGV1 and the first negative polarity grayscale voltage NGV1 to output the second positive polarity grayscale voltage PGV2 and the second negative polarity grayscale voltage NGV2, and thus the second positive polarity grayscale voltage PGV2 and the second negative polarity grayscale voltage NGV2 may be optimized. Thus, display quality of the display apparatus 100 may be improved.

Figure 7:
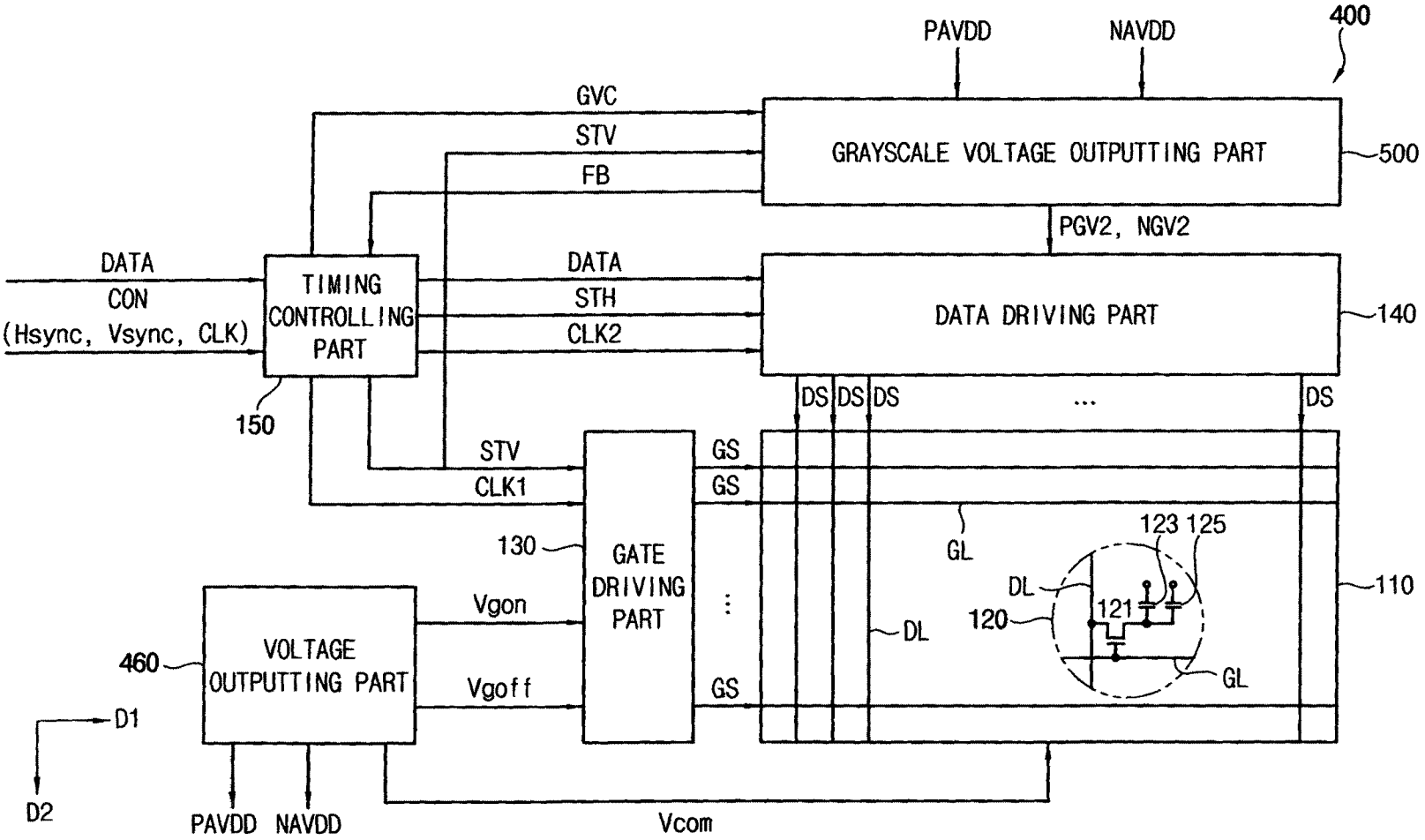
FIG. 7 is a block diagram illustrating a block diagram illustrating an exemplary embodiment of a display apparatus according to the invention.
Figure 8:
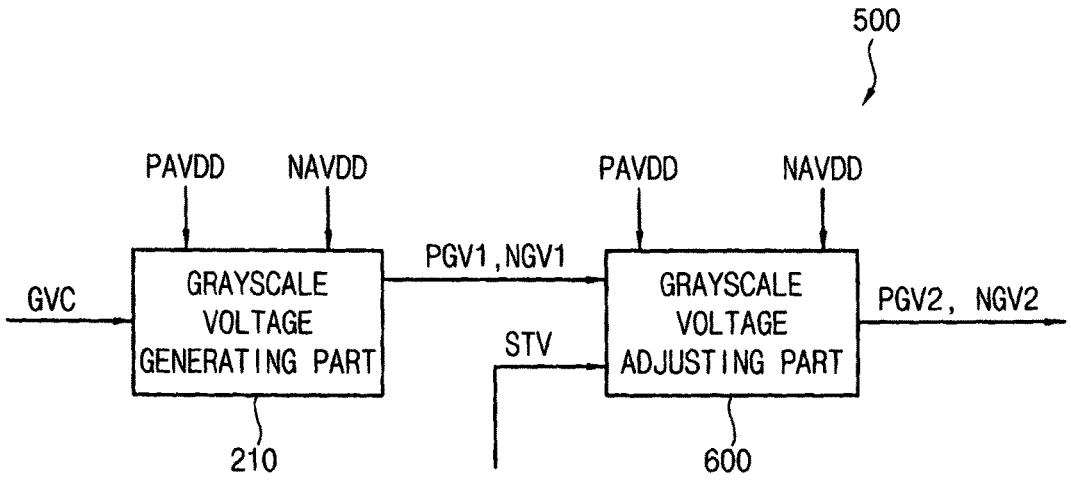
FIG. 8 is a block diagram illustrating a grayscale voltage outputting part of FIG. 7.

FIG. 7 is a block diagram illustrating a block diagram illustrating a display apparatus according to an exemplary embodiment of the invention. FIG. 8 is a block diagram illustrating a grayscale voltage outputting part 500 of FIG. 7.

The display apparatus 400 according to the illustrated exemplary embodiment illustrated in FIG. 7 is substantially the same as the display apparatus 100 according to the previous exemplary embodiment illustrated in FIG. 1 except for a voltage outputting part 460 and a grayscale voltage outputting part 500. Thus, the same reference numerals will be used to refer to same or like parts as those described in the previous exemplary embodiment and any further repetitive explanation concerning the above elements will be omitted.

Referring to FIGS. 7 and 8, the display apparatus 400 according to the illustrated exemplary embodiment includes the display panel 110, the gate driving part 130, the data driving part 140, the timing controlling part 150, the voltage outputting part 460 and the grayscale voltage outputting part 500. The gate driving part 130, the data driving part 140, the timing controlling part 150, the voltage outputting part 460 and the grayscale voltage outputting part 500 may be defined as a display panel driving apparatus driving the display panel 110.

The voltage outputting part 460 outputs the common voltage Vcom to the display panel 110. In addition, the voltage outputting part 460 outputs the gate on voltage Vgon and the gate off voltage Vgoff to the gate driving part 130. In addition, the voltage outputting part 460 outputs the positive polarity driving voltage PAVDD and the negative polarity driving voltage NAVDD to the grayscale voltage outputting part 500.

The grayscale voltage outputting part 500 may include a grayscale voltage generating part 210 and a grayscale voltage adjusting part 600.

The grayscale voltage generating part 210 generates the first positive polarity grayscale voltage PGV1 and the first negative polarity grayscale voltage NGV1 using the positive polarity driving voltage PAVDD and the negative polarity driving voltage NAVDD.

The grayscale voltage adjusting part 600 receives the first positive polarity grayscale voltage PGV1 and the first negative polarity grayscale voltage NGV1, and outputs a second positive polarity grayscale voltage PGV2 and a second negative polarity grayscale voltage NGV2 of which absolute values are different. Specifically, the absolute value of the second positive polarity grayscale voltage PGV2 and the absolute value of the second negative polarity grayscale value NGV2 may have a target voltage difference. The grayscale voltage adjusting part 600 may output the second positive polarity grayscale voltage PGV2 and the second negative polarity grayscale voltage NGV2 of which the absolute values are different based on the first positive polarity grayscale voltage PGV1, the first negative polarity grayscale voltage NGV1, the positive polarity driving voltage PAVDD and the negative polarity driving voltage NAVDD. In this case, the data driving part 140 may generate the data signal DS using the second positive polarity grayscale voltage PGV2 and the second negative polarity grayscale voltage NGV2.

The second positive polarity grayscale voltage PGV2 may be an adjusted voltage of the first positive polarity grayscale voltage PGV1 and the second negative polarity grayscale voltage NGV2 may be an adjusted voltage of the first negative polarity grayscale voltage NGV1. The grayscale voltage adjusting part 600 may output a feedback signal FB based on the second positive polarity grayscale voltage PGV2 and the second negative polarity grayscale voltage NGV2 to the timing controlling part 150. In this case, the timing controlling part 150 receiving the feedback signal FB may output the grayscale voltage control signal GVC for controlling the first positive polarity grayscale voltage PGV1 and the first positive polarity grayscale voltage PGV1 to the grayscale voltage outputting part 500. The grayscale voltage generating part 210 may generate the first positive polarity grayscale voltage PGV1 and the first negative polarity grayscale voltage NGV1 based on the grayscale voltage control signal GVC.

The grayscale voltage adjusting part 600 may output the second positive polarity grayscale voltage PGV2 and the second negative polarity grayscale voltage NGV2 in a frame period. In an exemplary embodiment, the grayscale voltage adjusting part 600 may receive the vertical start signal STV output from the timing controlling part 150, and may output the second positive polarity grayscale voltage PGV2 and the second negative polarity grayscale voltage NGV2 in an activation of the vertical start signal STV, for example.

Figure 9:
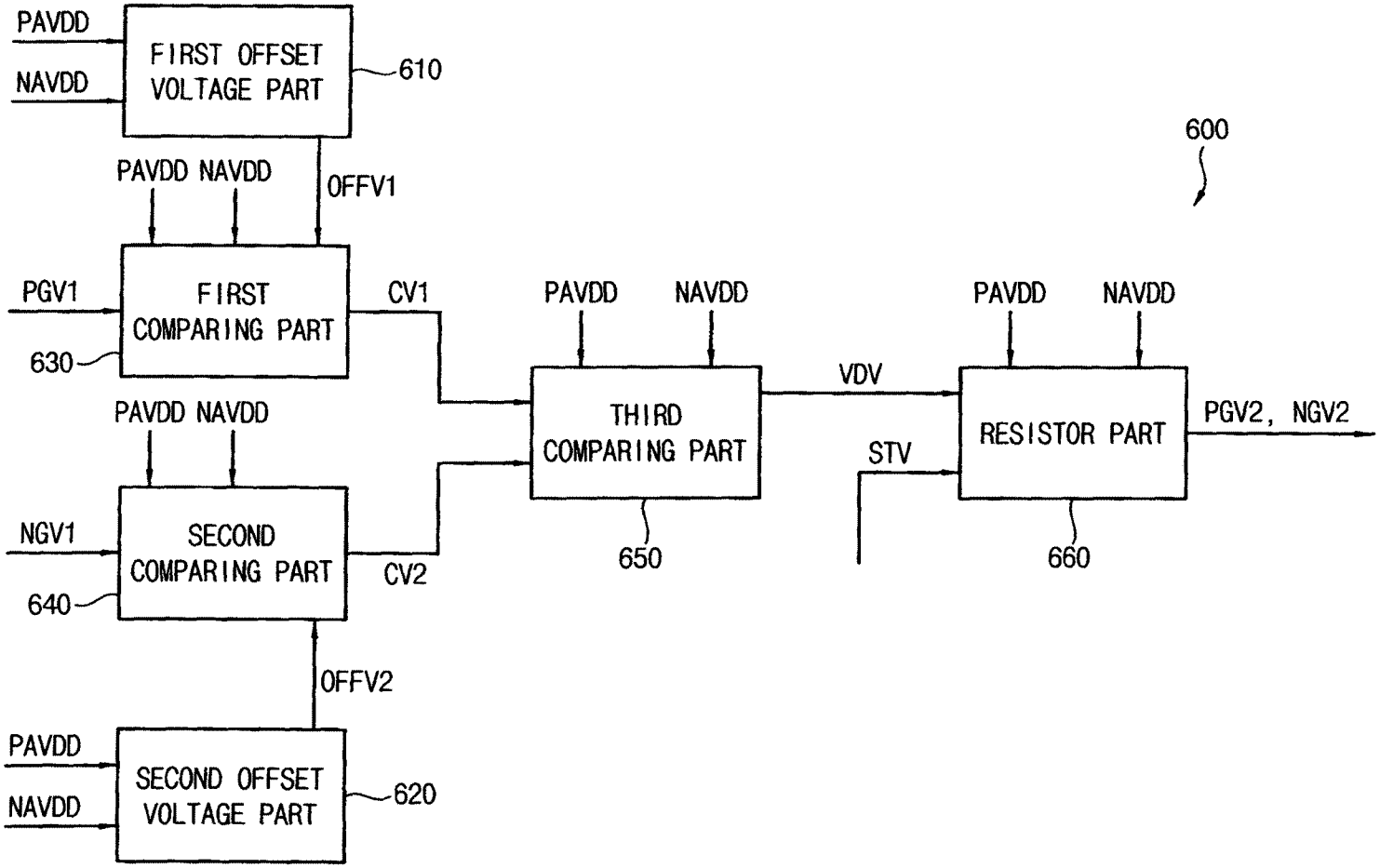
FIG. 9 is a block diagram illustrating a grayscale voltage adjusting part of FIG. 8.
Figure 10:
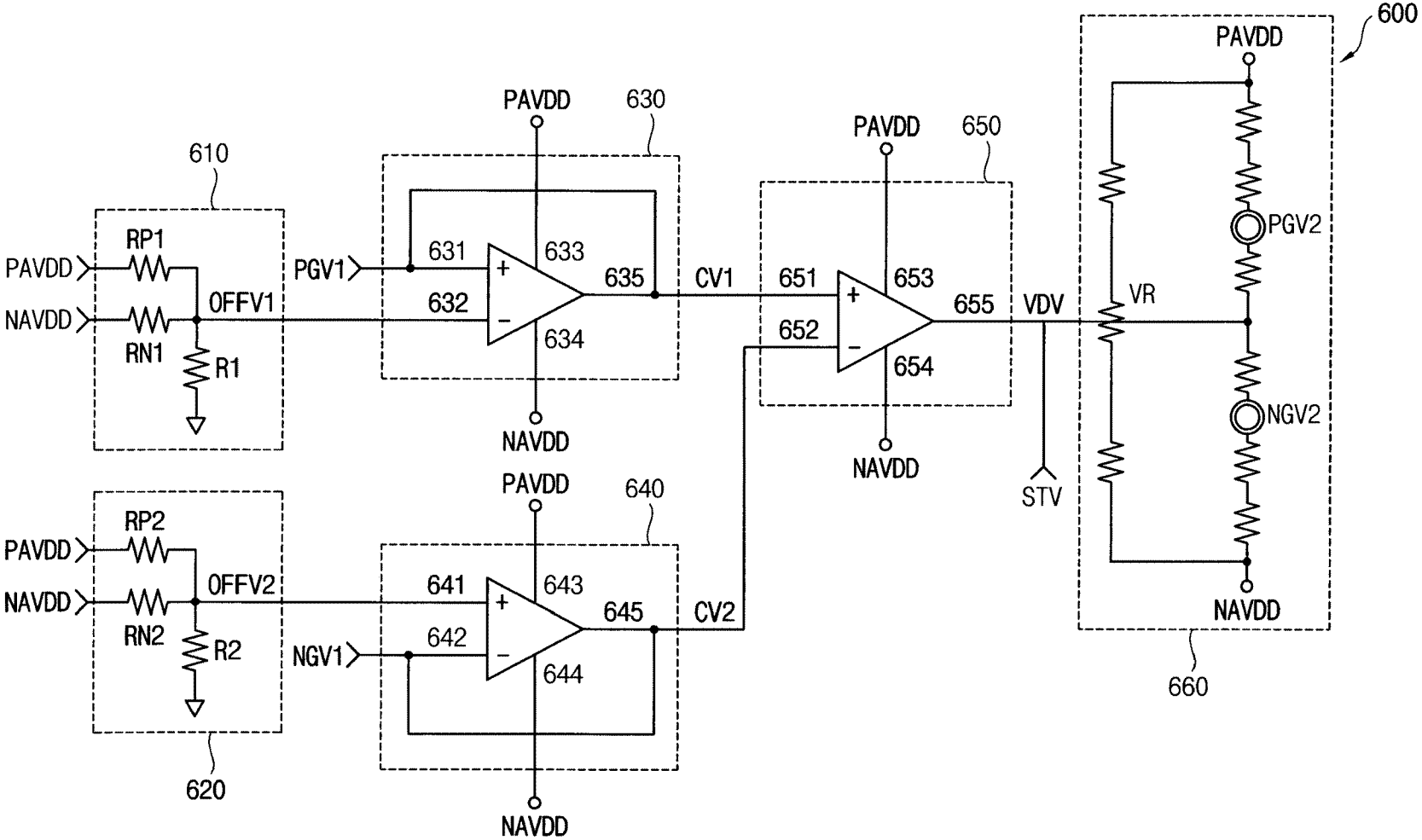
FIG. 10 is a circuit diagram illustrating the grayscale voltage adjusting part of FIG. 8.

FIG. 9 is a block diagram illustrating the grayscale voltage adjusting part 600 of FIG. 8. FIG. 10 is a circuit diagram illustrating the grayscale voltage adjusting part 600 of FIG. 8.

Referring to FIGS. 7 to 10, the grayscale voltage adjusting part 600 includes a first offset voltage part 610, a second offset voltage part 620, a first comparing part 630, a second comparing part 640, a third comparing part 650 and a resistor part 660.

The first offset voltage part 610 generates and adjusts a first offset voltage OFFV1. Specifically, the first offset voltage part 610 receives the positive polarity driving voltage PAVDD and the negative polarity driving voltage NAVDD, and includes a first resistor R1, a first positive polarity resistor RP1 and a first negative polarity resistor RN1. The first resistor R1 is connected between the first comparing part 630 and a terminal to which the ground voltage GND is applied. The first positive polarity resistor RP1 is connected to between the first resistor R1 and a terminal to which the positive polarity driving voltage PAVDD is applied. The first negative polarity resistor RN1 is connected between the first resistor R1 and a terminal to which the negative polarity driving voltage NAVDD is applied. The first offset voltage OFFV1 may be calculated by Equation 1.

$$OFFV1=PAVDD*(R1/(RP1+R1)) \quad \text{[Equation 1]}$$

Here, 'OFFV1' is the first offset voltage, 'PAVDD' is the positive polarity driving voltage, 'R1' is a resistance of the first resistor, and 'RP1' is a resistance of the first positive polarity resistor.

In an exemplary embodiment, when the positive polarity driving voltage PAVDD is about 5.4 V, the resistance of the first resistor R1 is about 100 ohms, and the resistance of the first positive polarity resistor RP1 is about 5400 ohms, the first offset voltage OFFV1 may be set as about 0.1 V, for example.

The second offset voltage part 620 generates and adjusts a second offset voltage OFFV2. Specifically, the second offset voltage part 620 receives the positive polarity driving voltage PAVDD and the negative polarity driving voltage NAVDD, and includes a second resistor R2, a second positive polarity resistor RP2 and a second negative polarity resistor RN2. The second resistor R2 is connected between the second comparing part 640 and a terminal to which the ground voltage GND is applied. The second positive polarity resistor RP2 is connected to between the second resistor R2 and a terminal to which the positive polarity driving voltage PAVDD is applied. The second negative polarity resistor RN2 is connected between the second resistor R2 and a terminal to which the negative polarity driving voltage NAVDD is applied. The second offset voltage OFFV2 may be calculated by Equation 2.

$$OFFV2=PAVDD*(R2/(RP2+R2)) \quad \text{[Equation 2]}$$

Here, 'OFFV2' is the second offset voltage, 'PAVDD' is the positive polarity driving voltage, 'R2' is a resistance of the second resistor, and 'RP2' is a resistance of the second positive polarity resistor.

In an exemplary embodiment, when the positive polarity driving voltage PAVDD is about 5.4 V, the resistance of the second resistor R2 is about 100 ohms, and the resistance of the second positive polarity resistor RP2 is about 5400 ohms, the second offset voltage OFFV2 may be set as about 0.1 V, for example.

The first comparing part 630 compares the first positive polarity grayscale voltage PGV1 with the first offset voltage OFFV1 to output a first comparison voltage CV1. The first offset voltage OFFV1 applied to the first comparing part 630 may be defined as a first reference voltage.

The first comparing part 630 may include an operational amplifier. The OP-AMP of the first comparing part 630 may include a first terminal 631, a second terminal 632, a third terminal 633, a fourth terminal 634 and a fifth terminal 635. The first terminal 631 is a non-inverting terminal and receives the first positive polarity grayscale voltage PGV1. The second terminal 632 is an inverting terminal and receives the first offset voltage OFFV1. The third terminal 633 receives the positive polarity driving voltage PAVDD. The fourth terminal 634 receives the negative polarity driving voltage NAVDD. The fifth terminal 635 is an output terminal and outputs the first comparison voltage CV1.

The second comparing part 640 compares the first negative polarity grayscale voltage NGV1 with the second offset voltage OFFV2 to output a second comparison voltage CV2. The second offset voltage OFFV2 applied to the second comparing part 640 may be defined as a second reference voltage.

The second comparing part 640 may include an operational amplifier. The OP-AMP of the second comparing part 640 may include a first terminal 641, a second terminal 642, a third terminal 643, a fourth terminal 644 and a fifth terminal 645. The first terminal 641 is a non-inverting terminal and receives the second offset voltage OFFV2. The second terminal 642 is an inverting terminal and receives the first negative polarity grayscale voltage NGV1. The third terminal 643 receives the positive polarity driving voltage PAVDD. The fourth terminal 644 receives the negative polarity driving voltage NAVDD. The fifth terminal 645 is an output terminal and outputs the second comparison voltage CV2.

The third comparing part 650 compares the first comparison voltage CV1 with the second comparison voltage CV2 to output a voltage deviation value VDV.

The third comparing part 650 may include an operational amplifier. The OP-AMP of the third comparing part 650 may a first terminal 651, a second terminal 652, a third terminal 653, a fourth terminal 654 and a fifth terminal 655. The first terminal 651 is a non-inverting terminal and receives the first comparison voltage CV1. The second terminal 652 is an inverting terminal and receives the second comparison voltage CV2. The third terminal 653 receives the positive polarity driving voltage PAVDD. The fourth terminal 654 receives the negative polarity driving voltage NAVDD. The fifth terminal 655 is an output terminal and outputs the voltage deviation value VDV.

The resistor part 660 controls a resistance thereof based on the voltage deviation value VDV and outputs the second positive polarity grayscale voltage PGV2 and the second negative polarity grayscale voltage NGV2. The positive polarity driving voltage PAVDD and the negative polarity driving voltage NAVDD are applied to the resistor part 660. The resistor part 660 includes a variable resistor VR of which the resistance is controlled based on the voltage deviation value VDV. In an exemplary embodiment, the variable resistor VR may be a digital variable resistor, for example. The resistor part 660 may output the second positive polarity grayscale voltage PGV2 and the second negative polarity grayscale voltage NGV2 by controlling the resistance of the variable resistor VR based on the voltage deviation value VDV, in response to the activation of the vertical start signal STV received from the timing controlling part 150. When the first comparison voltage CV1 and the second comparison voltage CV2 are substantially the same and thus the voltage deviation value is about zero, the resistor part 660 may not change the resistance of the variable resistor VR.

The grayscale voltage adjusting part 600 may further include a feedback signal part (not shown) which generates the feedback signal FB based on the second positive polarity grayscale voltage PGV2 and the second negative polarity grayscale voltage NGV2 and outputs the feedback signal FB to the timing controlling part 150.

Figure 11A:
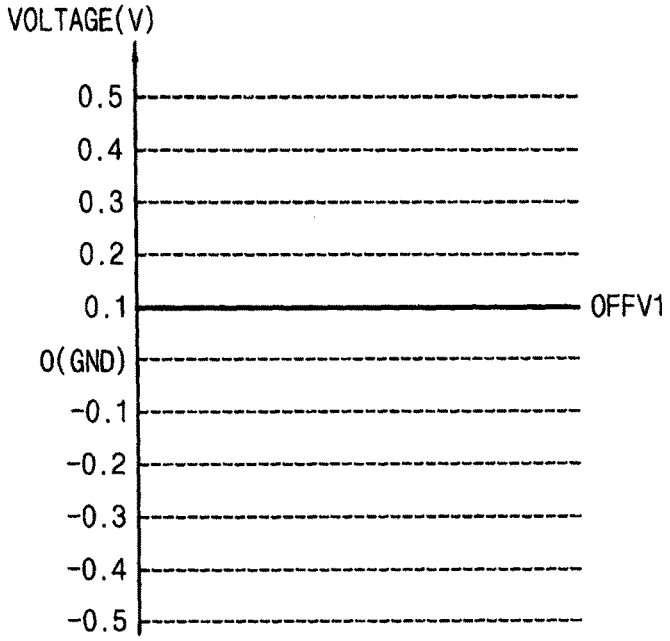
FIG. 11A is a graph illustrating a first offset voltage of FIGS. 9 and 10.
Figure 11B:
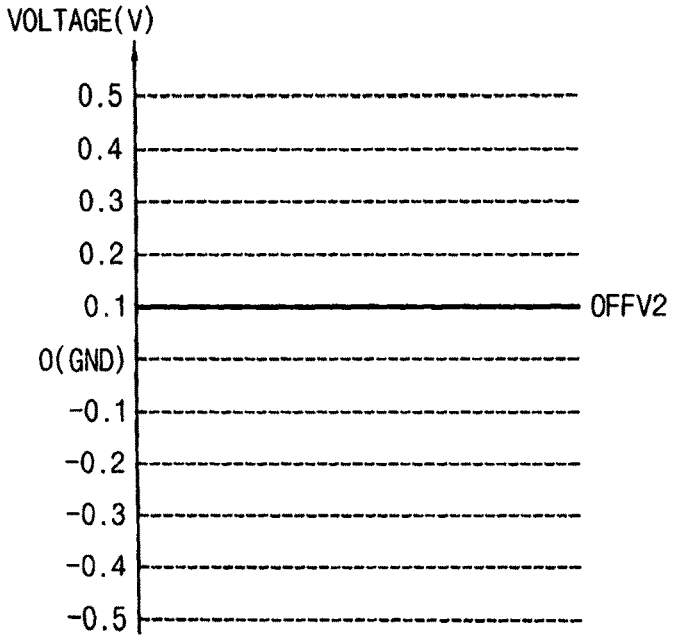
FIG. 11B is a graph illustrating a second offset voltage of FIGS. 9 and 10.
Figure 11C:
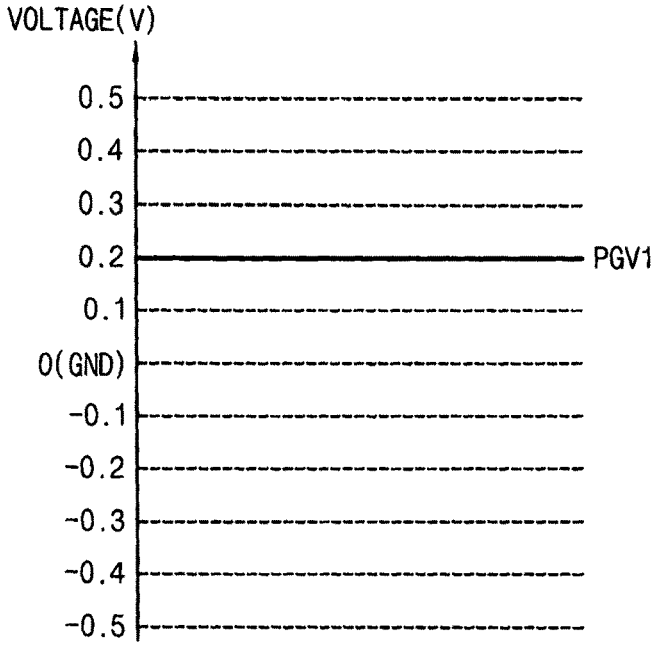
FIG. 11C is a graph illustrating a first positive polarity grayscale voltage of FIGS. 9 and 10.
Figure 11D:
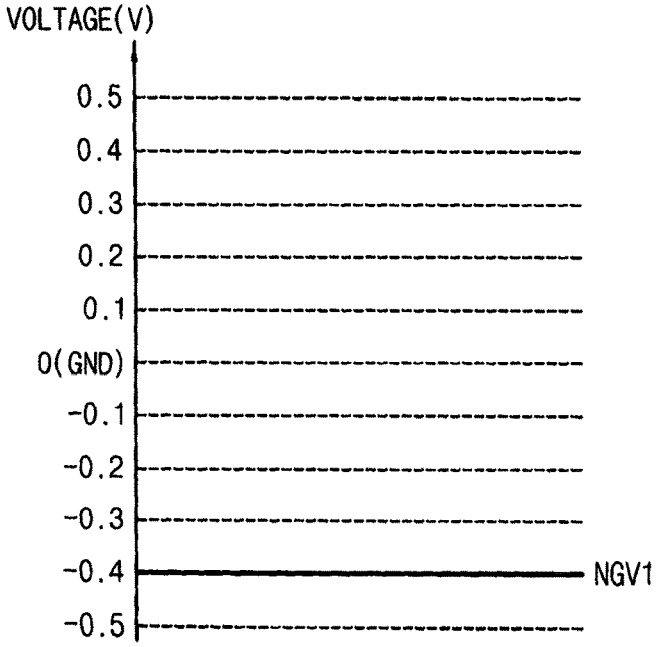
FIG. 11D is a graph illustrating a first negative polarity grayscale voltage of FIGS. 9 and 10.
Figure 11E:
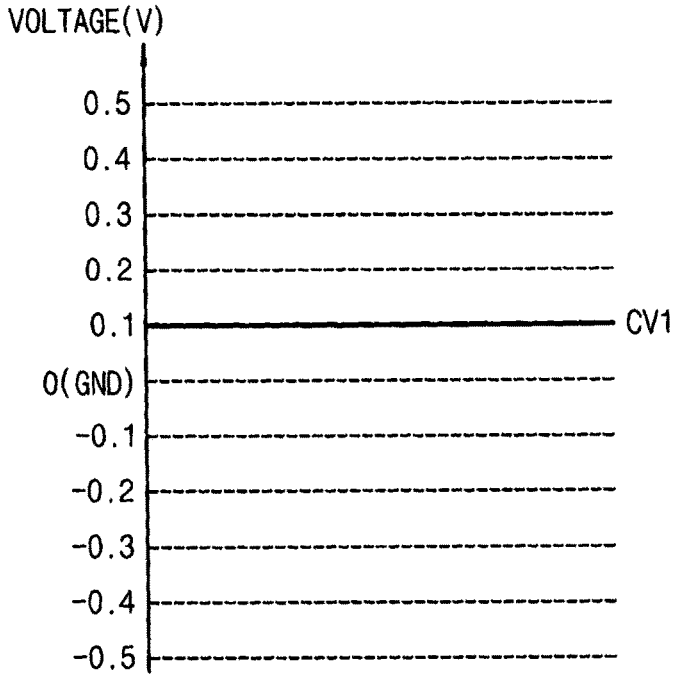
FIG. 11E is a graph illustrating a first comparison voltage of FIGS. 9 and 10.
Figure 11F:
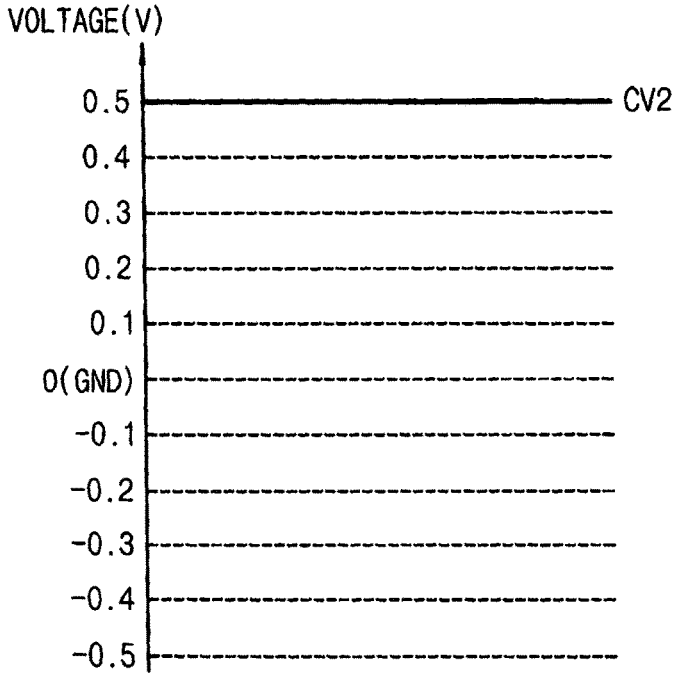
FIG. 11F is a graph illustrating a second comparison voltage of FIGS. 9 and 10.
Figure 11G:
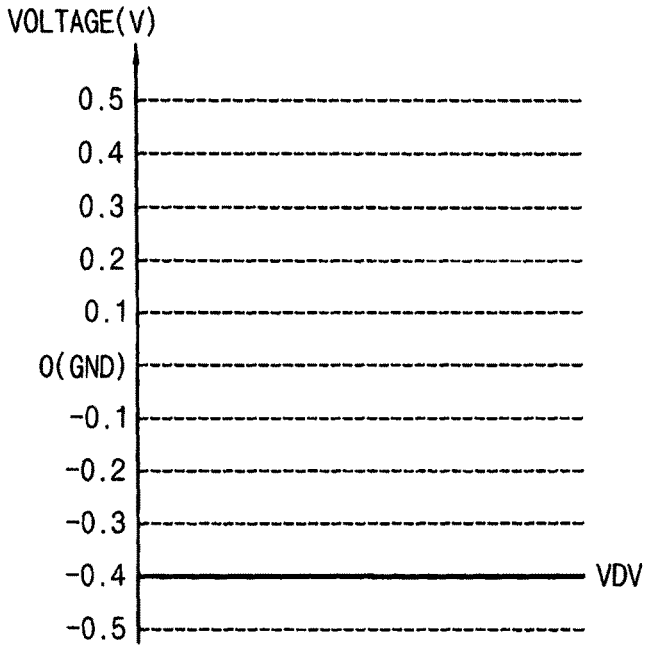
FIG. 11G is a graph illustrating a voltage deviation value of FIGS. 9 and 10.
Figure 11H:
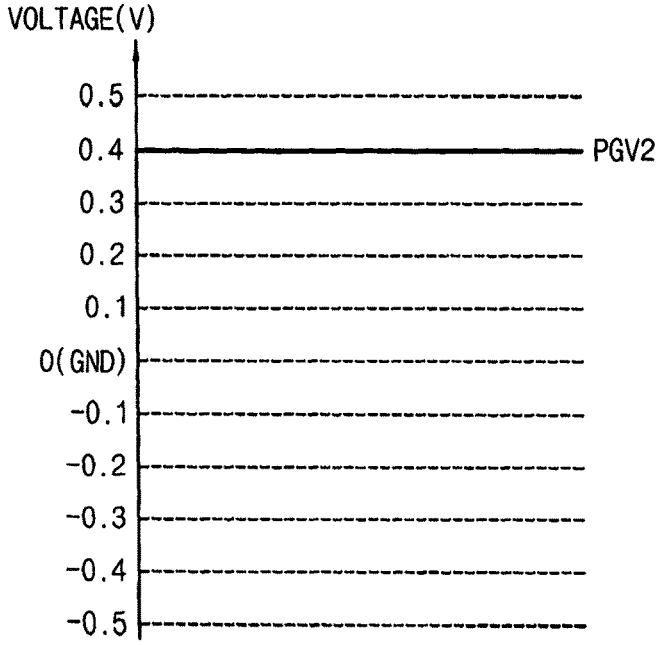
FIG. 11H is a graph illustrating a second positive polarity grayscale voltage of FIGS. 9 and 10.
Figure 11I:
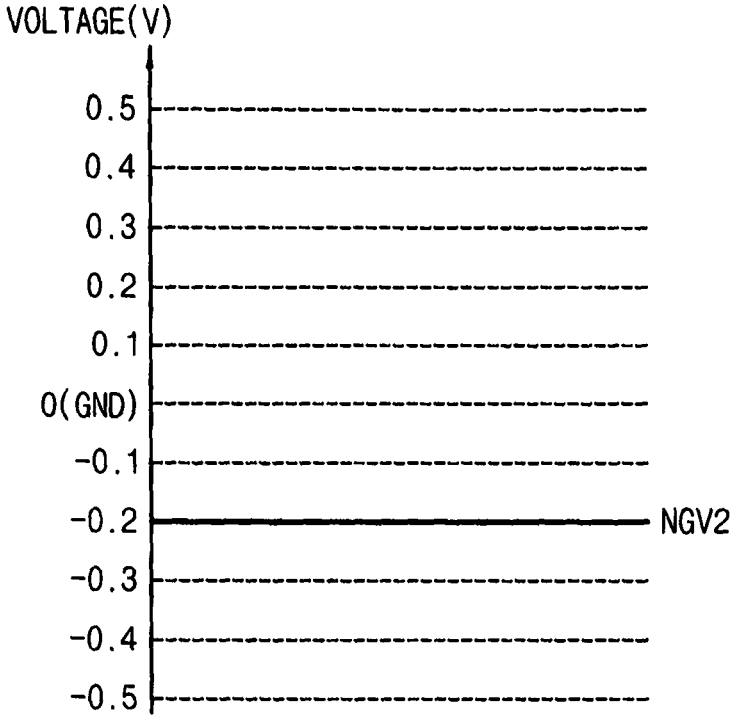
FIG. 11I is a graph illustrating a second negative polarity grayscale voltage of FIGS. 9 and 10.

FIG. 11A is a graph illustrating the first offset voltage OFFV1 of FIGS. 9 and 10. FIG. 11B is a graph illustrating the second offset voltage OFFV2 of FIGS. 9 and 10. FIG. 11C is a graph illustrating the first positive polarity grayscale voltage PGV1 of FIGS. 9 and 10. FIG. 11D is a graph illustrating the first negative polarity grayscale voltage NGV1 of FIGS. 9 and 10. FIG. 11E is a graph illustrating the first comparison voltage CV1 of FIGS. 9 and 10. FIG. 11F is a graph illustrating the second comparison voltage CV2 of FIGS. 9 and 10. FIG. 11G is a graph illustrating the voltage deviation value VDV of FIGS. 9 and 10. FIG. 11H is a graph illustrating the second positive polarity grayscale voltage PGV2 of FIGS. 9 and 10. FIG. 11I is a graph illustrating the second negative polarity grayscale voltage NGV2 of FIGS. 9 and 10.

Referring to FIGS. 7 to 11I, for example, the first offset voltage OFFV1 may be about 0.1 V, the second offset voltage OFFV2 may be about 0.1V, the first positive polarity grayscale voltage PGV1 may be about 0.2 V, and the first negative polarity grayscale voltage NGV1 may be about −0.4 V. Therefore, the first comparison voltage CV1 output from the first comparing part 630 may be about 0.1 V, and the second comparison voltage CV2 output from the second comparing part 640 may be about 0.5 V. Thus, the voltage deviation value VDV output from the third comparing part 650 may be about −0.4 V. The second positive polarity grayscale voltage PGV2 output from the resistor part 660 may be about 0.4 V, and the second negative polarity grayscale voltage NGV2 output from the resistor part 660 may be about −0.2 V. The resistor part 660 may output the second positive polarity grayscale voltage PGV2 having about 0.4 V and the second negative polarity grayscale voltage NGV2 having about −0.2 V by controlling the resistance of the variable resistor VR based on the voltage deviation value VDV having about −0.4 V.

Figure 12:
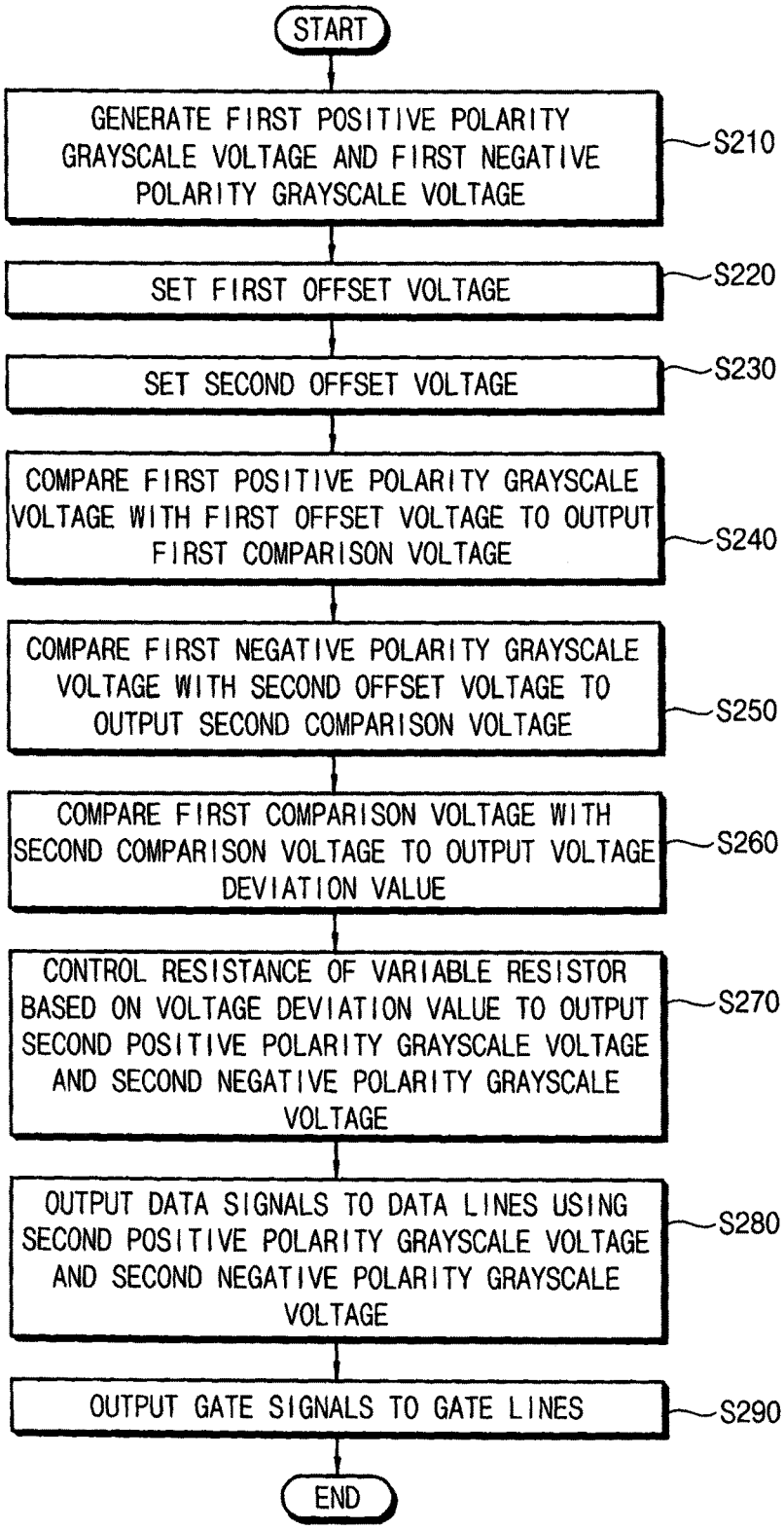
FIG. 12 is a flow chart illustrating a method of driving a display panel using a display panel driving apparatus of FIG. 7.

FIG. 12 is a flow chart illustrating a method of driving a display panel using the display panel driving apparatus of FIG. 7.

Referring to FIGS. 7 to 12, the first positive polarity grayscale voltage PGV1 and the first negative polarity grayscale voltage NGV1 are generated (operation S210). Specifically, the grayscale voltage generating part 210 generates the first positive polarity grayscale voltage PGV1 and the first negative polarity grayscale voltage NGV1 using the positive polarity driving voltage PAVDD and the negative polarity driving voltage NAVDD.

The first offset voltage OFFV1 is set (operation S220). Specifically, the first offset voltage part 610 generates and adjusts the first offset voltage OFFV1.

The second offset voltage OFFV2 is set (operation S230). Specifically, the second offset voltage part 620 generates and adjusts the second offset voltage OFFV2.

The first positive polarity grayscale voltage PGV1 is compared with the first offset voltage OFFV1 to output the first comparison voltage CV1 (operation S240). Specifically, the first comparing part compares the first positive polarity grayscale voltage PGV1 with the first offset voltage OFFV1 to output the first comparison voltage CV1. The first offset voltage OFF1 applied to the first comparing part 630 may be defined as the first reference voltage.

The first negative grayscale voltage NGV1 is compared with the second offset voltage OFFV2 to output the second comparison voltage CV2 (operation S250). Specifically, the second comparing part compares the first negative polarity grayscale voltage NGV1 with the second offset voltage OFFV2 to output the second comparison voltage CV2. The second offset voltage OFF2 applied to the second comparing part 640 may be defined as the second reference voltage.

The first comparison voltage CV1 is compared with the second comparison voltage CV2 to output the voltage deviation value VDV (operation S260). Specifically, the third comparing part 650 compares first comparison voltage CV1 with the second comparison voltage CV2 to output the voltage deviation value VDV.

The resistance is controlled based on the voltage deviation value VDV and the second positive polarity grayscale voltage PGV2 and the second negative polarity grayscale voltage NGV2 are output (operation S270). Specifically, the resistor part 660 controls the resistance of the variable resistor VR based on the voltage deviation value VDV and outputs the second positive polarity grayscale voltage PGV2 and the second negative polarity grayscale voltage NGV2. The resistor part 660 may output the second positive polarity grayscale voltage PGV2 and the second negative polarity grayscale voltage NGV2 by controlling the resistance of the variable resistor VR based on the voltage deviation value VDV, in response to the activation of the vertical start signal STV received from the timing controlling part 150.

The data signals DS are output to the data lines DL using the second positive polarity grayscale voltage PGV2 and the second negative polarity grayscale voltage NGV2 (operation S280). Specifically, the data driving part 140 generates the data signals DS based on the image data DATA using the second positive polarity grayscale voltage PGV2 and the second negative polarity grayscale voltage NGV2, and outputs the data signals DS to the data lines DL.

The gate signals GS are output to the gate lines GL (operation S290). Specifically, the gate driving part 130 generates the gate signals GS and outputs the gate signals GL to the gate lines GL.

According to the illustrated exemplary embodiment, the grayscale voltage adjusting part 600 controls the resistance of the variable resistor VR according to the voltage deviation value VDV based on the first positive polarity grayscale voltage PGV1 and the first negative polarity grayscale voltage NGV1 to output the second positive polarity grayscale voltage PGV2 and the second negative polarity grayscale voltage NGV2, and thus the second positive polarity grayscale voltage PGV2 and the second negative polarity grayscale voltage NGV2 may be optimized. Thus, display quality of the display apparatus 100 may be improved.

According to a display panel driving apparatus, a method of driving a display panel using the display panel driving apparatus, and a display apparatus having the display panel driving apparatus, a grayscale voltage adjusting part controls a resistance of a variable resistor according to a voltage deviation value based on a first positive polarity grayscale voltage and a first negative polarity grayscale voltage to output a second positive polarity grayscale voltage and a second negative polarity grayscale voltage, and thus the second positive polarity grayscale voltage and the second negative polarity grayscale voltage may be optimized. Thus, display quality of a display apparatus may be improved.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A display apparatus comprising:

a display panel which displays an image and comprising a gate line and a data line; and a display apparatus comprising a grayscale voltage outputting part which generates a first positive polarity grayscale voltage and a first negative polarity grayscale voltage, compares the first positive polarity with a first reference voltage to output a first comparison voltage, compares the first negative polarity grayscale voltage with a second reference voltage to output a second comparison voltage, compares the first comparison voltage with the second comparison voltage to output a voltage deviation value, and outputs a second positive polarity grayscale voltage and a second negative polarity grayscale voltage based on the voltage deviation value, a data driving part which outputs a data signal based on image data to the data line of the display panel, using the second positive polarity grayscale voltage and the second negative polarity grayscale voltage, and a gate driving part which outputs a gate signal to the gate line of the display panel.

2. The display apparatus of claim 1, further comprising:

a timing controlling part which controls a timing of the data driving part and a timing of the gate driving part, receives a feedback signal based on the second positive polarity grayscale voltage and the second negative polarity grayscale voltage, and outputs a grayscale voltage control signal for controlling the first positive polarity grayscale voltage and the first negative polarity grayscale voltage to the grayscale voltage outputting part, wherein the grayscale voltage outputting part receives a vertical start signal from the timing controlling part and outputs the second positive polarity grayscale voltage and the second negative polarity grayscale voltage in a frame period.

3. The display apparatus of claim 1, wherein the grayscale voltage outputting part comprises:

a grayscale voltage generating part which outputs the first positive polarity grayscale voltage and the first negative polarity grayscale voltage; and a grayscale voltage adjusting part which outputs the second positive polarity grayscale voltage and the second negative polarity grayscale voltage of which absolute values are the same, based on the first positive polarity grayscale voltage, the first negative polarity grayscale voltage, the first reference voltage, the second reference voltage, a positive polarity driving voltage and a negative polarity driving voltage.

4. The display apparatus of claim 3, wherein each of the first reference voltage and the second reference voltage is a ground voltage.

5. The display apparatus of claim 4, wherein the grayscale voltage adjusting part comprises:

a first comparing part which compares the first positive polarity grayscale voltage with the ground voltage to output a positive polarity grayscale voltage absolute value;

a second comparing part which compares the first negative polarity grayscale voltage with the ground voltage to output a negative polarity grayscale voltage absolute value;

a third comparing part which compares the positive polarity grayscale voltage absolute value with the negative polarity grayscale voltage absolute value to output the voltage deviation value; and a resistor part which controls a resistance based on the voltage deviation value and outputs the second positive polarity grayscale voltage and the second negative polarity grayscale voltage.

6. The display apparatus of claim 5, wherein the first comparing part comprises an operational amplifier including a first terminal which receives the first positive polarity grayscale voltage, a second terminal which receives the ground voltage, a third terminal which receives the positive polarity driving voltage, a fourth terminal which receives the negative polarity driving voltage, and a fifth terminal which outputs the positive polarity grayscale voltage absolute value.

7. The display apparatus of claim 5, wherein the second comparing part comprises an operational amplifier including a first terminal which receives the ground voltage, a second terminal which receives the first negative polarity grayscale voltage, a third terminal which receives the positive polarity driving voltage, a fourth terminal which receives the negative polarity driving voltage, and a fifth terminal which outputs the negative polarity grayscale voltage absolute value.

8. The display apparatus of claim 5, wherein the third comparing part comprises an operational amplifier including a first terminal which receives the positive polarity grayscale voltage absolute value, a second terminal which receives the negative polarity grayscale voltage absolute value, a third terminal which receives the positive polarity driving voltage, a fourth terminal which receives the negative polarity driving voltage, and a fifth terminal which outputs the voltage deviation value.

9. The display apparatus of claim 5, wherein the resistor part comprises a variable resistor of which the resistance is controlled according to the voltage deviation value.

10. The display apparatus of claim 1, wherein the grayscale voltage outputting part comprises:

a grayscale voltage generating part which outputs the first positive polarity grayscale voltage and the first negative polarity grayscale voltage; and a grayscale voltage adjusting part which outputs the second positive polarity grayscale voltage and the second negative polarity grayscale voltage of which absolute values are different, based on the first positive polarity grayscale voltage, the first negative polarity grayscale voltage, a positive polarity driving voltage and a negative polarity driving voltage.

11. The display apparatus of claim 10, wherein the first reference voltage is a first offset voltage and the second reference voltage is a second offset voltage, and wherein the grayscale voltage adjusting part comprises:

a first comparing part which compares the first positive polarity grayscale voltage with the first offset voltage to output the first comparison voltage;

a second comparing part which compares the first negative polarity grayscale voltage with the second offset voltage to output the second comparison voltage;

a third comparing part which compares the first comparison voltage with the second comparison voltage to output the voltage deviation value; and a resistor part which controls a resistance based on the voltage deviation value and outputs the second positive polarity grayscale voltage and the second negative polarity grayscale voltage.

12. The display apparatus of claim 11, wherein the first comparing part comprises an operational amplifier including a first terminal which receives the first positive polarity grayscale voltage, a second terminal which receives the first offset voltage, a third terminal which receives the positive polarity driving voltage, a fourth terminal which receives the negative polarity driving voltage, and a fifth terminal which outputs the first comparison voltage.

13. The display apparatus of claim 11, wherein the second comparing part comprises an operational amplifier including a first terminal which receives the second offset voltage, a second terminal which receives the first negative polarity grayscale voltage, a third terminal which receives the positive polarity driving voltage, a fourth terminal which receives the negative polarity driving voltage, and a fifth terminal which outputs the second comparison voltage.

14. The display apparatus of claim 11, wherein the third comparing part comprises an operational amplifier including a first terminal which receives the first comparison voltage, a second terminal which receives the second comparison voltage, a third terminal which receives the positive polarity driving voltage, a fourth terminal which receives the negative polarity driving voltage, and a fifth terminal which outputs the voltage deviation value.

15. The display apparatus of claim 14, wherein the resistor part comprises a variable resistor of which the resistance is controlled according to the voltage deviation value.

16. The display apparatus of claim 11, wherein the grayscale voltage adjusting part further comprises:

a first offset voltage part which outputs the first offset voltage; and a second offset voltage part which outputs the second offset voltage.

17. The display apparatus of claim 16, wherein the first offset voltage part comprises:

a first resistor connected between the first comparing part and a terminal to which a ground voltage is applied;

a first positive polarity resistor connected between the first resistor and a terminal to which the positive polarity driving voltage is applied; and a first negative polarity resistor connected between the first resistor and a terminal to which the negative polarity driving voltage is applied.

18. The display apparatus of claim 16, wherein the second offset voltage part comprises:

a second resistor connected between the second comparing part and a terminal to which a ground voltage is applied;

a second positive polarity resistor connected between the second resistor and a terminal to which the positive polarity driving voltage is applied; and a second negative polarity resistor connected between the second resistor and a terminal to which the negative polarity driving voltage is applied.

* * * * *